US007419934B2

(12) United States Patent
Yamamoto et al.

(10) Patent No.: US 7,419,934 B2
(45) Date of Patent: Sep. 2, 2008

(54) REVERSIBLE THERMOSENSITIVE COLORING MATERIAL AND REVERSIBLE THERMOSENSITIVE RECORDING MATERIAL USING THE REVERSIBLE THERMOSENSITIVE COLORING MATERIAL

(75) Inventors: Satoshi Yamamoto, Yokohama (JP); Hiromi Furuya, Sunto-gun (JP); Kyohji Okada, Fuji (JP)

(73) Assignee: Ricoh Company Limited, Tokyo (JP)

( * ) Notice: Subject to any disclaimer, the term of this patent is extended or adjusted under 35 U.S.C. 154(b) by 0 days.

(21) Appl. No.: 11/742,771

(22) Filed: May 1, 2007

(65) Prior Publication Data

US 2007/0259782 A1 Nov. 8, 2007

(30) Foreign Application Priority Data

May 8, 2006 (JP) ..... 2006-128829

(51) Int. Cl.
*B41M 5/337* (2006.01)

(52) U.S. Cl. ..... 503/201; 503/216

(58) Field of Classification Search ..... None
See application file for complete search history.

(56) References Cited

U.S. PATENT DOCUMENTS

| | | | |
|---|---|---|---|
| 6,207,613 | B1 | 3/2001 | Torii et al. |
| 6,261,992 | B1 | 7/2001 | Furuya et al. |
| 2001/0025587 | A1 | 10/2001 | Torii et al. |

FOREIGN PATENT DOCUMENTS

| | | |
|---|---|---|
| JP | 60-193691 | 10/1985 |
| JP | 61-237684 | 10/1986 |
| JP | 62-138568 | 6/1987 |
| JP | 63-107584 | 5/1988 |
| JP | 63-173684 | 7/1988 |
| JP | 2-188293 | 7/1990 |
| JP | 2-188294 | 7/1990 |
| JP | 4-78573 | 3/1992 |
| JP | 5-124360 | 5/1993 |
| JP | 5-294063 | 11/1993 |
| JP | 6-59746 | 8/1994 |
| JP | 7-8931 | 2/1995 |
| JP | 7-285271 | 10/1995 |
| JP | 8-108627 | 4/1996 |
| JP | 10-67177 | 3/1998 |
| JP | 10-95175 | 4/1998 |
| JP | 11-70731 | 3/1999 |
| JP | 2001-47749 | 2/2001 |
| JP | 3349820 | 9/2002 |

(Continued)

*Primary Examiner*—Bruce H Hess
(74) *Attorney, Agent, or Firm*—Oblon, Spivak, McClelland, Maier & Neustadt, P.C.

(57) ABSTRACT

A reversible thermosensitive coloring material which can reversibly achieve a relatively colored state and a relatively discolored state depending on a temperature to which the coloring material is heated or a cooling speed at which the coloring material is cooled after heated. The coloring material including an electron donating coloring agent; an electron accepting color developer configured to color the coloring agent; and a compound having a Zwitter ion in which a total of charges in a molecule of the compound is zero. A reversible thermosensitive recording material including a substrate and a reversible thermosensitive recording layer, which is located overlying the substrate and which includes the reversible thermosensitive coloring material.

12 Claims, 3 Drawing Sheets

FOREIGN PATENT DOCUMENTS

| | | |
|---|---|---|
| JP | 3380277 | 12/2002 |
| JP | 3474366 | 9/2003 |
| JP | 3544420 | 4/2004 |
| JP | 3544429 | 4/2004 |
| JP | 3544431 | 4/2004 |
| JP | 3674827 | 5/2005 |
| JP | 3678932 | 5/2005 |

REVERSIBLE THERMOSENSITIVE COLORING MATERIAL AND REVERSIBLE THERMOSENSITIVE RECORDING MATERIAL USING THE REVERSIBLE THERMOSENSITIVE COLORING MATERIAL

BACKGROUND OF THE INVENTION

1. Field of the Invention

The present invention relates to a reversible thermosensitive coloring material, which achieves a relatively colored state or a relatively discolored state utilizing a coloring reaction of an electron donating coloring compound with an electron accepting compound. In addition, the present invention also relates to a reversible thermosensitive recording material, which includes a reversible thermosensitive coloring material and which can reversibly record and erase an image by controlling the heat energy applied to the reversible thermosensitive coloring material.

2. Discussion of the Background

Thermosensitive recording materials, which record images utilizing a coloring reaction of an electron donating coloring compound (hereinafter referred to as a coloring agent or a leuco dye) with an electron accepting compound (hereinafter referred to as a color developer), are well known. Such thermosensitive recording materials are broadly used for output media of facsimiles, word processors and various measuring instruments as well as various tickets and price labels. In addition, recently the thermosensitive recording materials are used for magnetic thermosensitive recording media such as prepaid cards and reward cards.

Since these thermosensitive recording materials utilize an irreversible coloring reaction, the recording materials cannot reversibly record and erase images. Therefore the thermosensitive recording materials cannot be reused, resulting in increase of wastes. In the case of cards, new information is recorded in a space of a recording area of the cards. Therefore, when the recording area of a card is filled with recorded information (i.e., when the recording area has no recording space), the card has to be replaced with a new card. Accordingly, a need exists for a reversible thermosensitive recording material, which can reversibly record and erase images many times in order to save materials.

In attempting to fulfill the need, various reversible thermosensitive recording media have been proposed, and some of the recording media are marketed now.

For example, published unexamined Japanese patent applications Nos. (hereinafter referred to as JP-As) 63-107584 and 04-078573 have disclosed polymer-type reversible thermosensitive recording media utilizing a physical change, in which a transparent state and an opaque state are reversibly achieved.

In addition, dye-type reversible thermosensitive recording media utilizing a chemical change have been proposed. For example, JP-A 60-193691 discloses a dye-type reversible thermosensitive recording medium using a combination of gallic acid with phloroglucinol. JP-A 61-237684 discloses a dye-type reversible thermosensitive recording medium using compound (e.g., phenolphthalein and thymolphthalein) as a color developer. JP-As 62-138556, 62-138568 and 62-140881 have disclosed dye-type reversible thermosensitive recording media having a recording layer including a homogeneous mixture of a coloring agent, a color developer and a carboxylic acid ester. JP-A 63-173684 discloses a dye-type reversible thermosensitive recording medium including an ascorbic acid derivative as a color developer. JP-As 02-188293 and 02-188294 disclose a salt of bis(hydroxyphenyl)acetic acid or gallic acid with a higher aliphatic amine as a color developer.

JP-A 05-124360 proposes a reversible thermosensitive recording medium using a coloring agent and a color developer. It is described therein that by using a combination of a specific color developer (e.g., an organic phosphoric acid compound, an aliphatic carboxylic acid, or a phenolic compound, which has a long chain aliphatic hydrocarbon group) with a coloring agent (e.g., a leuco dye), a color image can be easily formed and erased reversibly when properly controlling the heating and cooling conditions. The reversible thermosensitive recording medium can reversibly achieve a colored state and a non-colored state many times, and the colored state and non-colored state can be stably maintained at room temperature. With respect to the reversible thermosensitive recording medium, JP-A 06-210954 further discloses that a phenolic compound having a long chain aliphatic hydrocarbon group having a specific structure is used as a color developer.

The above-mentioned reversible thermosensitive recording media tend to have the following drawbacks:

(1) the erasing speed is so slow that it takes a long time to perform rewriting;

(2) recorded images are not satisfactorily erased; and (3) recorded images have poor heat stability.

In attempting to remedy the drawback, i.e., to improve the practicality of the reversible thermosensitive recording media, and the usability of the reversible thermosensitive recording media for small-sized low energy printers, there is a need for a reversible thermosensitive recording material which can perform erasure of a former image and record of a new image at the same time using a thermal printhead. In attempting to fulfill the need, various coloring/discoloring control agents or discoloring promoters have been developed. For example, JP-As 09-048175, 09-290563 and 11-070731 have disclosed use of a long chain alkyl compound to attempt to improve the erasability of the recording media or both of the erasability and stability of recorded images.

Further, JP-A 05-294063 discloses a reversible thermosensitive recording medium including a discoloring promoter, such as fatty acids, salts of fatty acids, waxes, higher alcohols, esters of phosphoric acid, benzoic acid, phthalic acid and oxy acids, silicone oils, liquid crystal compounds, surfactants, etc.

These reversible thermosensitive recording materials are not satisfactory in view of high speed erasability (i.e., a residual image is present even after image erasure) when a thermal printhead is used as a recording/erasing device.

In addition, it is proposed to use ionic salts as discoloring promoters. For example, JP-A 08-108627 discloses a combination of a specific coloring developer with a quaternary ammonium salt or an alkylene oxide. However, these recording materials have unsatisfactory high-temperature preservability.

JP-A09-300820 uses onium salts as discoloring promoters. JP-A 10-044607 uses quaternary ammonium salts having a complex aromatic ring as discoloring promoters. JP-A 2000-263946 discloses combinations of a discoloring agent having a polar group (e.g., onium salts, and quaternary ammonium salts having a complex aromatic ring) with a specific color developer. JP-As 2000-313171 and 2001-047749 have disclosed combinations of a quaternary ammonium salts with a specific color developer.

However, these reversible thermosensitive recording media including such an ionic discoloring promoter have a drawback in that recorded images are erased at a relatively low temperature, and therefore recorded images have poor preservability when preserved at a relatively high temperature of about 50° C. In addition, the reversible thermosensitive recording materials are not satisfactory in view of high-speed erasability (i.e., a residual image is present even after image erasure).

Further, JP-As 07-285270 and 07-285271 disclose compounds having both an acidic group (such as carboxyl groups and sulfo groups) and a basic group (such as amino groups) as discoloring promoters. However, these reversible thermosensitive recording media are also not satisfactory in view of high-speed erasability and high-temperature preservability of recorded images.

Because of these reasons, a need exists for a reversible thermosensitive recording material which can record a high-contrast image while having a good combination of high-speed erasability and high-temperature preservability.

SUMMARY OF THE INVENTION

As an aspect of the present invention, a reversible thermosensitive coloring material is provided which can reversibly achieve a relatively colored state and a relatively discolored state depending on the temperature to which the coloring material is heated or the cooling speed at which the coloring material is cooled after heated, wherein the coloring material includes, as a coloring/discoloring control agent, a compound having a Zwitter ion in which the total of charges in a molecule of the compound is zero.

It is preferable that the compound having a Zwitter ion has one or more nitrogen cations ($N^+$) and one or more anions selected from the group consisting of $O^-$, $COO^-$ and $SO_3^-$. The compound having a Zwitter ion preferably has the following formula (1):

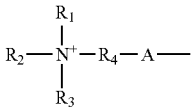

(1)

wherein each of $R_1$, $R_2$ and $R_3$ represents a saturated or unsaturated hydrocarbon group having 1 to 22 carbon atoms, or a group having the below-mentioned formula (A), wherein $R_1$, $R_2$ and $R_3$ optionally share bond connectivity to form a ring; $R_4$ represents a saturated or unsaturated hydrocarbon group having 1 to 18 carbon atoms, which optionally includes a hydroxyl group; and A represents an anion selected from the group consisting of $O^-$, $COO^-$ and $SO_3^-$, $$R_5—(—X—R_6—)_n— \quad (A)$$

wherein $R_5$ represents a saturated or unsaturated hydrocarbon group having 1 to 22 carbon atoms; $R_6$ represents a saturated or unsaturated divalent hydrocarbon group having 1 to 18 carbon atoms; X represents a group selected from the group consisting of carbamoyl groups, amide groups, urea groups, diacylhydrazine groups, ether groups, and ester groups; n is an integer of from 1 to 3, wherein when n is 2 or more, each of $R_6$ is the same as or different from each other and each of X is the same as or different from each other.

As another aspect of the present invention, a reversible thermosensitive recording material is provided which includes a substrate and a recording layer which is located overlying the substrate and which includes the reversible thermosensitive coloring material mentioned above. In this regard, "overlying" can include direct contact and allow for one or more intermediate layers.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

The present inventors have investigated the coloring and discoloring phenomenon of reversible thermosensitive coloring materials including a coloring agent, a color developer and a coloring/discoloring control agent or a discoloring promoter. As a result of the investigation, it is found that the intermolecular cohesive force of each of the color developer having a long chain aliphatic group, the coloring agent (i.e., leuco dye) and the coloring/discoloring control agent or the discoloring promoter, and the interactions of these materials are important for the discoloring phenomenon. In addition, the present inventors pay attention to ionic compounds, and have investigated influence of such ionic compounds on the coloring and discoloring phenomena of thermosensitive coloring materials.

It is known that among such ionic compounds, anionic compounds can impart good coloring property to thermosensitive coloring materials. However, the coloring agents included in the thermosensitive coloring materials are colored by such anionic compounds, and thereby problems in that the discoloring property of the thermosensitive coloring materials deteriorates, and the background area of images formed by the coloring materials is colored occur. Therefore, anionic compounds cannot be used as the coloring/discoloring control agent. In contrast, some cationic compounds can impart a good discoloring property to thermosensitive coloring materials. However, such cationic compounds cause a problem in that discoloring is caused at a relatively low temperature (i.e., the recorded images have poor high temperature preservability). It is considered that these problems are caused by the acidic groups and basic groups included in the ionic compounds.

The present inventors have investigated while considering that it is important to curb the influence of ionic compounds on the coloring and discoloring phenomena and to utilize polar groups and dipole moment of the ionic compounds for the coloring and discoloring phenomena. As a result of the present inventors' investigation, it is discovered that by using a compound having a Zwitter ion, in which the total of charges in a molecule is zero, as a coloring/discoloring agent, the resultant reversible thermosensitive coloring material has a good combination of coloring property, high-speed discoloring property and high-temperature preservability can be provided.

The present invention will be explained in detail.

Figure 1:
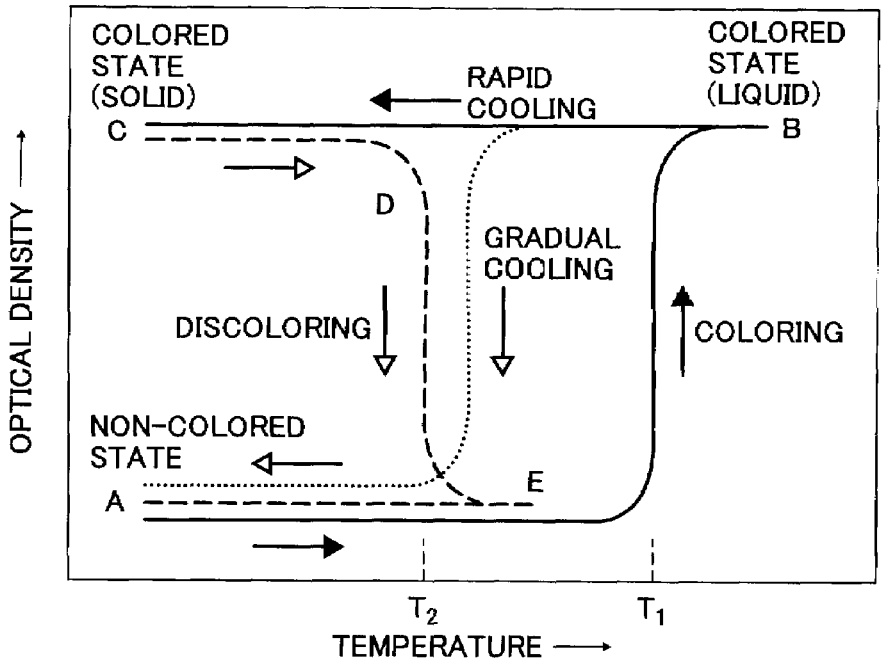
FIG. 1 is a schematic view illustrating the image forming/erasing properties of an embodiment of the reversible thermosensitive recording medium of the present invention.

FIG. 1 is a graph illustrating the relationship between the temperature of a reversible thermosensitive recording material (hereinafter referred to as a recording material) and the optical density of the recording material (hereinafter referred to as an image density) thereof. When the recording material which is in a non-colored state A (i.e., a relatively discolored state) is heated, the recording material begins to color at an image forming temperature T1 in which an electron donating coloring agent and an electron accepting color developer are melted and mixed, and then achieves a melted colored state B. If the recording material in the melted colored state B is rapidly cooled to room temperature, the recording material keeps the colored state and achieves a cooled colored state C in which the electron donating coloring agent and the electron accepting color developer are almost solidified. In this regard, whether the recording material remains in the colored state depends upon the cooling speed. Specifically, if the recording material is gradually cooled, the recording material returns to the non-colored state A (along a dotted line B-A) or achieves a semi-colored state in which the image density of the recording material is relatively low compared to the image density of the recording material in the cooled colored state C. If the recording material in the cooled colored state C is heated again, the recording material begins to discolor at an image erasing temperature T2 lower than the image forming temperature T1, and achieves a non-colored state E (along a broken line C-D-E). If the recording material in the non-colored state E is cooled to room temperature, the recording material returns to the non-colored state A. The temperatures T1 and T2 change depending on the properties of the coloring agent and the color developer used. Accordingly, by appropriately selecting a coloring agent and a color developer, a recording material having desired coloring and discoloring temperatures T1 and T2 can be obtained. The image densities of the recording material in the colored states B and C are not necessarily the same.

In the colored state C, the coloring agent and the color developer in the recording material typically form a solid in which a molecule of the coloring agent and a molecule of the color developer are mixed while contacting with each other. In this state, the color developer and coloring agent cohere and thereby the colored state can be stably maintained.

In contrast, in the non-colored state the coloring agent and the color developer are separated from the other. Specifically, at least one of the coloring agent and the color developer aggregates to form a domain, or crystallizes, thereby each phase of the coloring agent and the color developer is isolated from the other, and accordingly the recording material stably achieves the non-colored state. In the recording material of the present invention, the cohered structure of the coloring agent and the color developer is changed to a structure in which each of the phases of the coloring agent and the color developer is isolated from the other or the color developer crystallizes, thereby color erasure can be perfectly performed. In a process of from the colored state B or C to the non-colored state A illustrated in FIG. 1, the structures of the coloring agent and color developer change (i.e., the coloring agent and color developer cause phase separation and the color developer crystallizes).

In reversible thermosensitive recording materials, it is considered that the more stable the cohesion structure of the recording material in the colored state, the better image density stability the recording material has. In addition, it is considered that in the discoloring process, crystallization of the color developer, which has been in a cohesion state when the recording material has a colored state, is caused at a higher speed, and therefore the recording material has good discoloring property. Therefore, it has been attempted to improve the stability of the colored state and discoloring property of recording materials by using a coloring/discoloring control agent having a long chain alkyl group in which an association group capable of forming a hydrogen bond is incorporated.

Such a conventional coloring/discoloring control agent can impart both of good static discoloring property such that discoloring can be well performed using a heat stamp and good high speed discoloring property such that high speed discoloring can be performed using a thermal printhead to the recording material, but deteriorates the coloring property and preservability of the recording material. Namely, there is no conventional coloring/discoloring control agent, which can impart a good combination of coloring property, discoloring property (particularly, high speed discoloring property) and high temperature preservability to the recording material.

The present inventors discover that when a compound having a Zwitter ion is used as a coloring/discoloring control agent, the resultant recording material has a good combination of coloring property and high-speed discoloring property and high-temperature preservability. The compounds having a Zwitter ion are defined as compounds having a structure such that a cation and an anion are connected to each other with a covalent bond therebetween or compounds having a bipolar structure such that a cation and an anion are connected to each other without a covalent bond therebetween while a negative charge is present on an electrically negative atom (such as oxygen atom in a N-oxide structure ($N^+$—$O^-$). In this regard, the total of charges in a molecule of the compounds is zero. Compounds having a Zwitter ion are greatly different from ionic compounds (such as cationic compounds (e.g., quaternary ammonium salts) and anionic compounds (e.g., sulfonium salts)) in which a cation or an anion forms an ionic bond with a counter ion and the apparent charges are zero. In addition, compounds having a Zwitter ion are greatly different from compounds having a non-ionized covalent bond, such as aminocarboxylic acids (e.g., amino acids) having a carboxyl group and an amino group in a molecule.

The coloring/discoloring control agent for use in the recording material of the present invention is characterized by having a Zwitter ion. In such a coloring/discoloring control agent, both of a cation and an anion are present in a molecule while the center of gravity of a cation is different from that of an anion. Therefore, the coloring/discoloring control agent has an electric dipole therein. It is considered that such an electric dipole serves an important role in coloring and discoloring processes. The mechanism of such compounds having a Zwitter ion for improving the coloring and discoloring properties of a recording material are not yet determined, but is considered to be as follows.

For example, lets assume a recording material in which a fluoran compound is used as a leuco dye (i.e., an electron donating material). In the non-colored state of the recording material, charges are not eccentrically located in the fluoran compound having a dibenzooxazole ring, which is substituted with an amino group, and a closed lactone ring, and therefore there is no dipole in the compound. In contrast, in the colored state, charges are eccentrically located in the fluoran compound and therefore there is a dipole in the compound due to the interaction between the fluoran compound and the color developer included in the recording material. In this case, the compound has an open lactone ring having a quinoid structure, which has an electron donating property, and an amino group having a low electron density. In this regard, recording materials using a phthalide compound or an azaphthalide compound as leuco dyes are the same as the recording materials using fluoran compounds as leuco dyes.

Although each of molecules of the leuco dye has a dipole, dipoles of the molecules of the leuco dye in the recording material achieving a colored state (i.e., a cohesion state) are canceled and therefore the dipole moment (i.e., the intensity and direction of dipole) of the system is zero. When the state of the recording material is changed from a colored state to a non-colored state, the structure of the recording material is changed. When the structure of the recording material is changed, the recording material loses the cohesion structure. In this case, the recording material instantaneously loses the symmetry property, resulting in induction of a dipole moment. In this regard, a reversible cohesive force is formed, which is caused by the induced dipoles and the dipoles of the coloring/discoloring control agent, and thereby the leuco dye is separated from the color developer (i.e., the distance between molecules of the leuco dye and molecules of the color developer is widened), resulting in acceleration of discoloring.

According to the above-mentioned mechanism, it is considered that when the state of the recording material is changed from a non-colored state to a colored state, the colored leuco dye returns to a non-colored state due to the dipoles of the coloring/discoloring control agent, and therefore the recording material cannot achieve a good colored state. However, in reality the recording material can achieve a good colored state. As a result of the present inventors investigation, the reason therefor is considered to be as follows. In a static state (such as a colored state and a non-colored state), the interaction between the coloring/discoloring control agent and the coloring material (i.e., the coloring agent and color developer) is little. Only in a dynamic state (e.g., in a state of from a colored state to a non-colored state), the effect of the coloring/discoloring control agent is produced, and thereby change of from a colored state to a non-colored state can be easily performed. As a result of the present inventors' experiments, it is found that compounds having a Zwitter ion can allow a recording material to easily change from a colored state to a non-colored state at a high discoloring speed without affecting the static properties such as image density, and high-temperature preservability.

Compounds having a Zwitter ion have good effects on structural changes (i.e., changes between a colored state and a non-colored state) of a reversible thermosensitive coloring material including a coloring agent and a color developer having a long chain aliphatic hydrocarbon group. In particular, such compounds have excellent effects on a reversible thermosensitive coloring material including a coloring agent and a phenolic compound which serves as a color developer and which includes a long chain aliphatic hydrocarbon group having not less than 8 carbon atoms. Specifically, compounds having a Zwitter ion can have better effects on reversible thermosensitive coloring materials including a color developer having a long chain aliphatic hydrocarbon group than reversible thermosensitive coloring materials including a color developer, such as salts of bis(hydroxyphenyl)acetic acid and a higher aliphatic amine, which exhibits an acidic property or a basic property upon application of heat thereto to color or discolor a coloring agent.

Specific examples of the compounds having a Zwitter ion include the following compounds, but are not limited thereto.

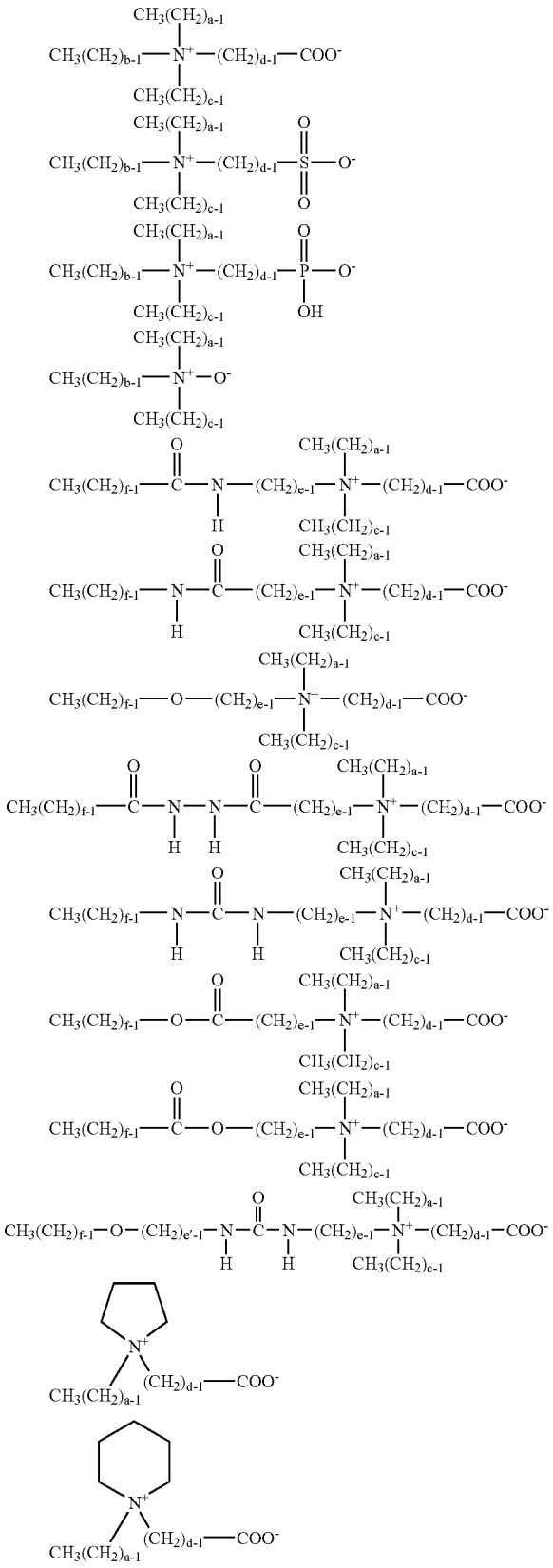

-continued

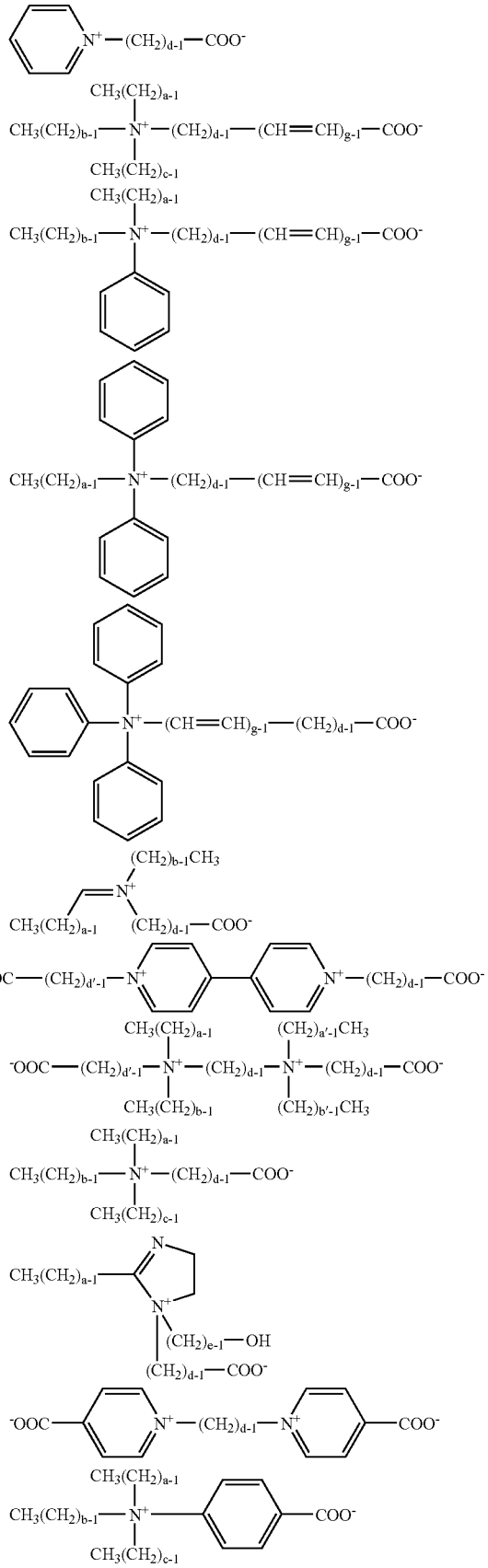

-continued

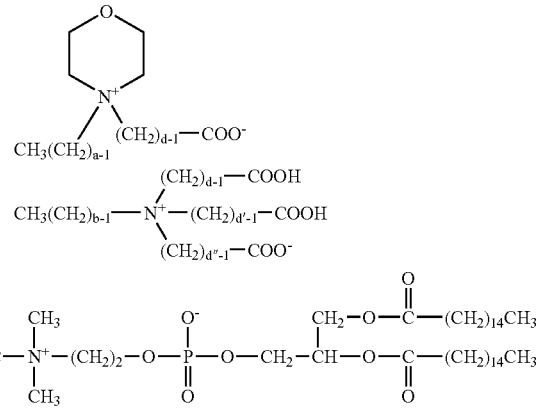

In the above-described formulae, each of characters, a, b, c, d, e, f, g, d', d'' and e' represents an integer, and preferably an integer of from 1 to 30. When the same characters are present in a formula, the characters may be the same as or different from each other.

Among these compounds, compounds having the following formula (1) are preferable.

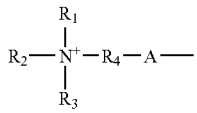

(1)

wherein each of $R_1$, $R_2$ and $R_3$ represents a saturated or unsaturated hydrocarbon group having 1 to 22 carbon atoms, or a group having the below-mentioned formula (A), wherein $R_1$, $R_2$ and $R_3$ optionally share bond connectivity to form a ring; $R_4$ represents a saturated or unsaturated hydrocarbon group having 1 to 18 carbon atoms, which optionally includes a hydroxyl group; and A represents an anion selected from the group consisting of $O^-$, $COO^-$ and $SO_3^-$, (A)

wherein $R_5$ represents a saturated or unsaturated hydrocarbon group having 1 to 22 carbon atoms; $R_6$ represents a saturated or unsaturated divalent hydrocarbon group having 1 to 18 carbon atoms; X represents a group selected from the group consisting of carbamoyl groups, amide groups, urea groups, diacylhydrazine groups, ether groups, and ester groups; n is an integer of from 1 to 3, wherein when n is 2 or more, each of $R_6$ is the same as or different from each other and each of X is the same as or different from each other.

Among the compounds having formula (1), compounds having the following formulae are preferable, but the compound having a Zwitter ion for use in the recording material of the present invention is not limited thereto.

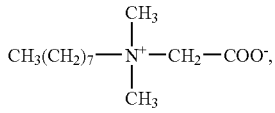

-continued

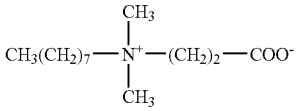

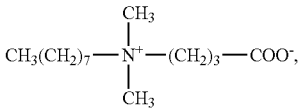

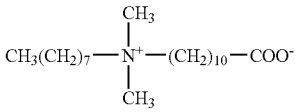

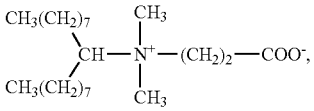

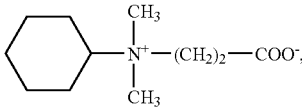

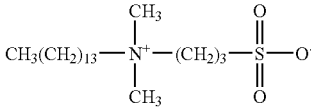

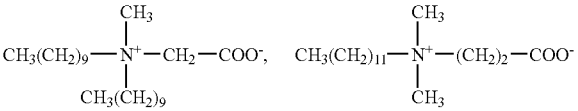

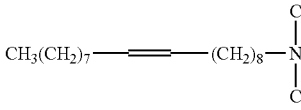

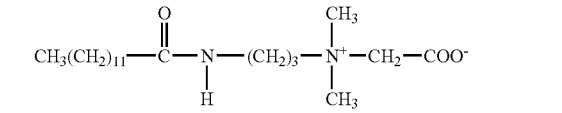

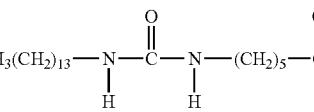

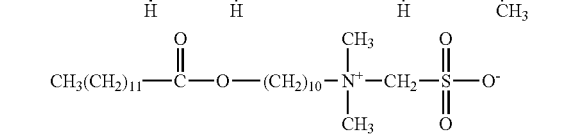

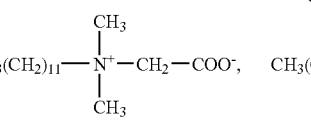

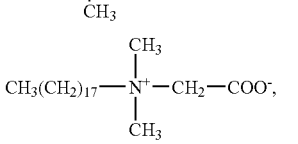

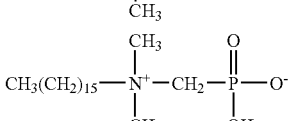

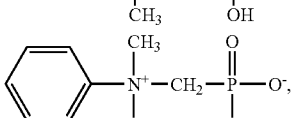

-continued

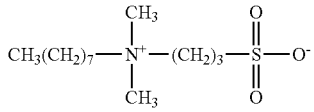

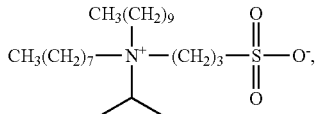

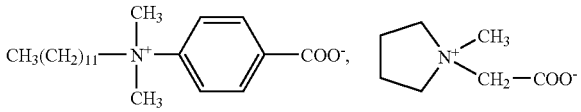

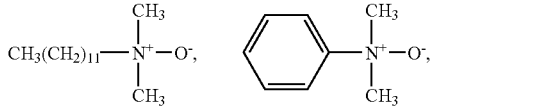

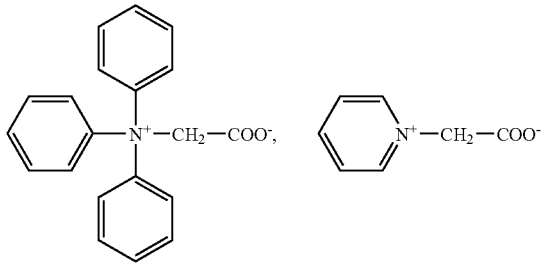

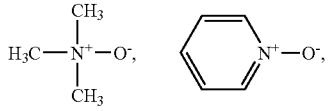

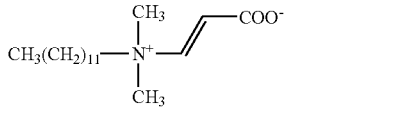

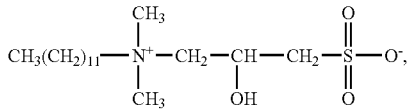

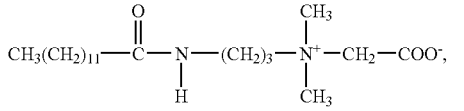

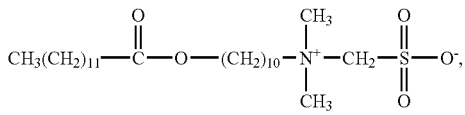

and

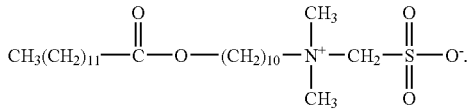

The color developer for use in the recording material of the present invention is not particularly limited, and any compounds which can allow a coloring agent to reversibly achieve a relatively colored state and a relatively discolored state depending on the temperature to which the compounds and the coloring agent are heated and/or the cooling speed after the heating. However, phenolic compounds having the following formulae, which have an aliphatic group having not less than 8 carbon atoms, are more preferably used.

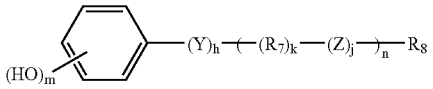

wherein each of Y and Z represents a divalent group including a hetero atom, and each of h and j is 0 or 1, wherein both of h and j are not 0 at the same time; $R_7$ represents a divalent hydrocarbon group having 1 to 22 carbon atoms; k is 0 or 1; $R_8$ represents a hydrocarbon group having 8 to 30 carbon atoms; m is an integer of from 1 to 3; and n is 0 or an integer of from 1 to 4, wherein when n is an integer of from 2 to 4, each of $R_7$ is the same as or different from each other and each of Z is the same as or different from each other, and wherein when n is 0, h is 1.

Specifically, each of $R_7$ and $R_8$ represents a substituted or unsubstituted hydrocarbon group which may be an aliphatic hydrocarbon group, an aromatic hydrocarbon group or a combination thereof and which may be linear or branched. In addition, an unsaturated group may be included therein. Specific examples of the substituents include hydroxyl groups, halogen atoms, alkoxyl groups, etc.

When $R_8$ has not greater than 7 carbon atoms, the stability of the colored state and the discoloring property of the recording material tend to deteriorate. Therefore, the number of carbon atoms of $R_8$ is preferably not less than 8 and more preferably not less than 11.

Each of Y and Z represents a divalent group having a hetero atom, and is preferably a group including at least one of the following groups.

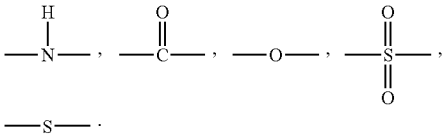

Specific examples of the groups for use as each of the Y and Z include the following:

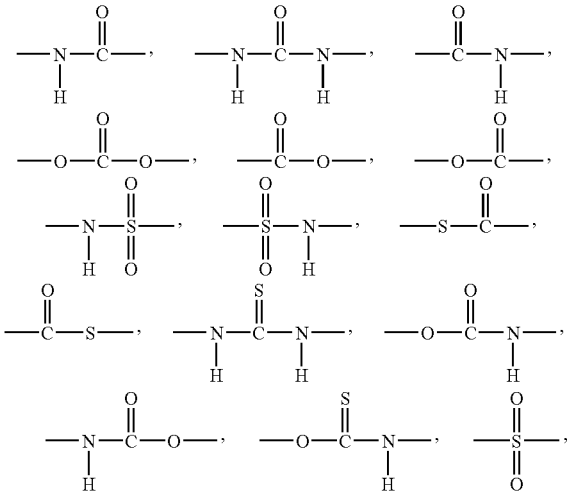

-continued

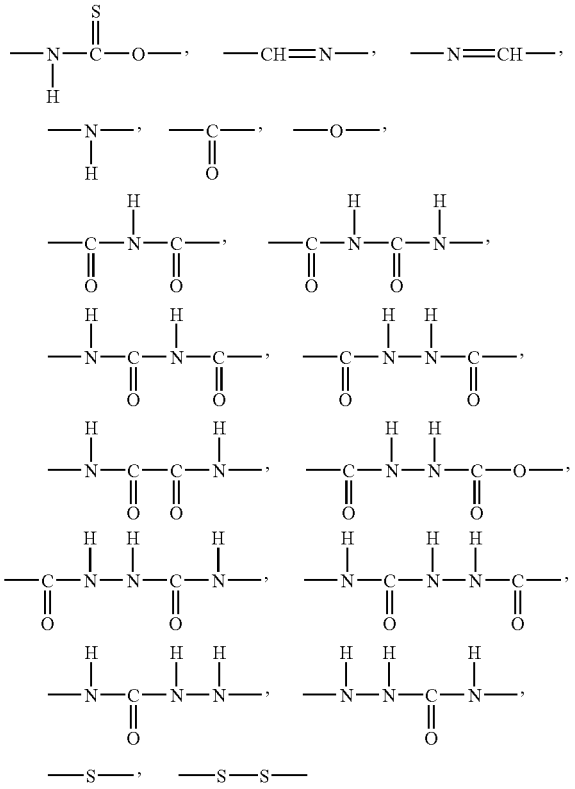

Specific examples of the phenolic compounds include the below-mentioned compounds, but are not limited thereto.

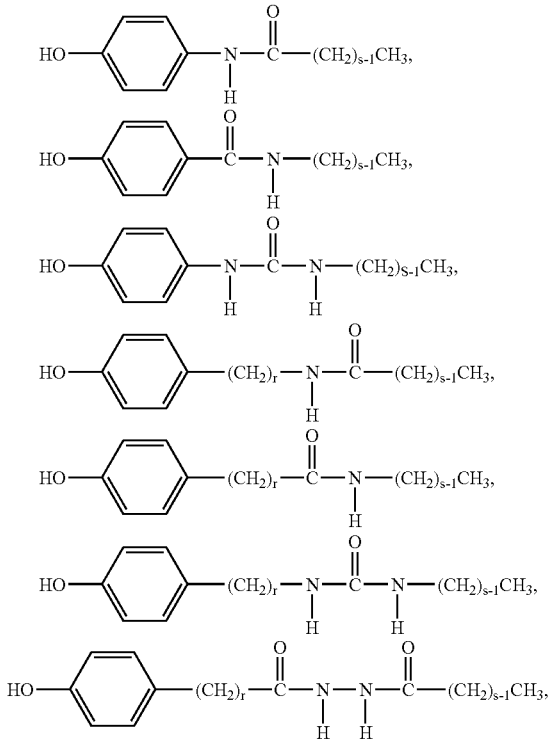

-continued

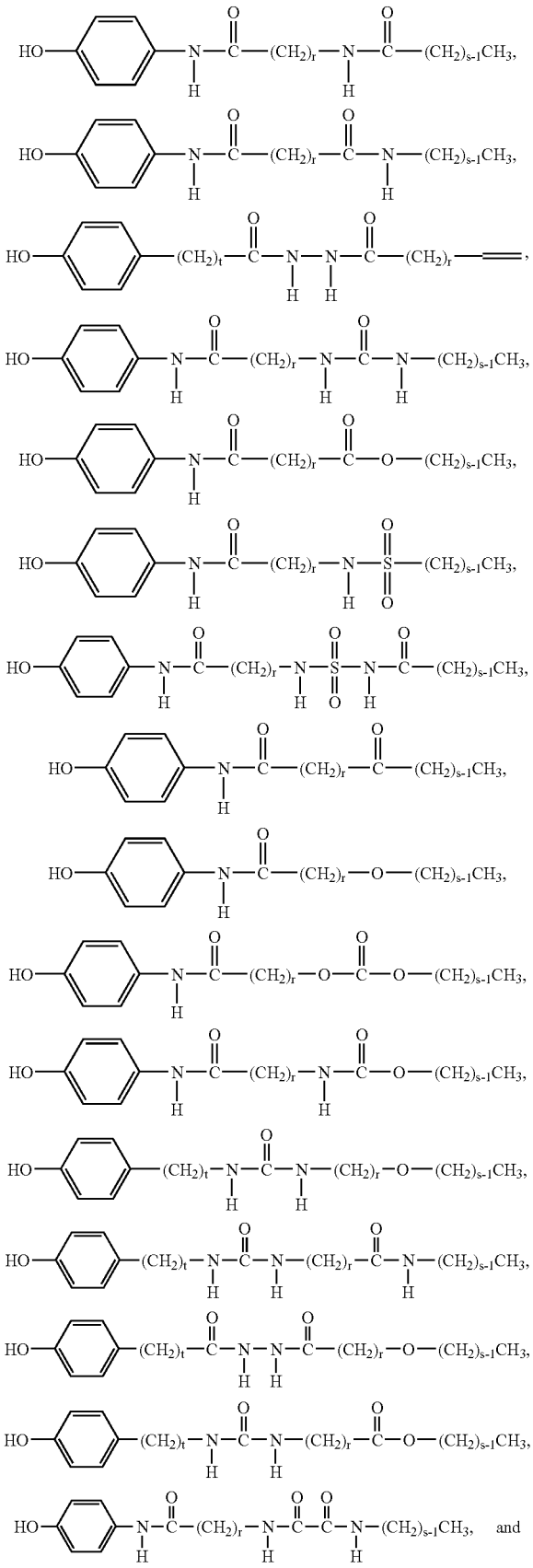

-continued

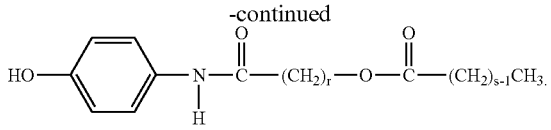

In the formulae described above, each of t, r and s is an integer such that the numbers of $R_7$ and $R_8$ are satisfied.

In addition, color developers described in, for example, JP-As 05-124360, 06-210954, 10-095175, 09-290563, 11-188969 and 11-099749 incorporated herein by reference can also be used as the color developer in the present invention.

The content of the compound having a Zwitter ion in the reversible thermosensitive coloring material of the present invention is from 0.1 to 50% by weight, and preferably from 1 to 30% by weight, based on the weight of the color developer included in the coloring material. When the content is too low, the effects of the compound cannot be produced. In contrast, when the content is too high, the optical density of a colored portion decreases. Compounds having a Zwitter ion can be used alone or in combination.

The method for preparing a coating liquid for the recording layer of the recording material, which includes the coloring material (i.e., at least a coloring agent, a color developer and a coloring/discoloring control agent), is not particularly limited, and for example, the following methods can be used.

(1) Each of the constituents (i.e., at least a coloring agent, a color developer and a coloring/discoloring control agent) is dissolved or dispersed in a solvent, and then the solutions and/or dispersions are mixed to prepare a coating liquid.

(2) The constituents are mixed and the mixture is dissolved and/or dispersed in a solvent to prepare a coating liquid.

(3) The constituents are mixed and melted upon application of heat thereto, followed by cooling. The cooled mixture is dissolved or dispersed in a solvent to prepare a coating liquid.

If desired, a dispersant can be used when a dispersion is prepared.

Suitable materials for use as the coloring agent (i.e., leuco dyes) of the reversible thermosensitive coloring material include known dye precursors such as phthalide compounds, azaphthalide compounds, and fluoran compounds. Specific examples thereof include the leuco dyes described in JP-As 05-124360, 06-210954 and 10-230680 incorporated herein by reference.

Among these leuco dyes, the following leuco dyes are preferably used.

2-anilino-3-methyl-6-diethylaminofluoran,
2-anilino-3-methyl-6-di(butylamino)fluoran,
2-anilino-3-methyl-6-(N-n-propyl-N-methylamino)fluoran,
2-anilino-3-methyl-6-(N-isopropyl-N-methylamino)fluoran,
2-anilino-3-methyl-6-(N-isobutyl-N-methylamino)fluoran,
2-anilino-3-methyl-6-(N-n-amyl-N-methylamino)fluoran,
2-anilino-3-methyl-6-(N-ethyl-p-toluidino)fluoran,
3-(1-ethyl-2-methylindole-3-yl)-3-(2-ethoxy-4-diethylaminophenyl)-4-azaphthalide,
3-(1-ethyl-2-methylindole-3-yl)-3-(2-ethoxy-4-diethylaminophenyl)-7-azaphthalide, etc.

Suitable materials for use as the color developer, which is included in the recording layer, include the color developers disclosed in JP-As 05-124360, 06-210954 and 10-095175 incorporated herein by reference. Namely, compounds which have both of a structure capable of coloring a leuco dye, such as a phenolic hydroxyl group, a carboxyl group and a phosphate group, and a structure capable of controlling the intermolecular cohesive force, such as long chain hydrocarbon groups. A group having a hetero atom and di- or more-valence may be intervened between the two structures. In addition, the intervened group may include a group having a hetero atom, and the long chain hydrocarbon group may include such an intervened group having a hetero atom and/or an aromatic group. The color developers disclosed in JP-As 09-290563, 11-188969 and 11-099749 incorporated herein by reference can also be used in the present invention.

Among these color developers, N-(4-hydroxyphenyl)-N'-octadecylurea, N-{11-(p-hydroxyphenyl)undecano-N'-n-decanohydrazide, N-{3-(p-hydroxyphenyl)propiono-N'-n-docosanohydrazide, etc., can be preferably used.

The recording layer of the recording material of the present invention can include a crosslinked resin. Specific examples thereof include crosslinked resins of resins having a group capable of reacting with a crosslinking agent, such as acrylic polyol resins, polyester polyol resins, polyurethane polyol resins, phenoxy resins, polyvinyl butyral resins, cellulose acetate propionate resins, cellulose acetate butyrate resins, and resins which are reaction products of a monomer having a group capable of reacting with a crosslinking agent with another monomer, but are not limited thereto. The recording layer preferably includes a resin having a hydroxyl value of not less than 70 mgKOH/g, and more preferably not less than 90 mgKOH/g. Specific examples thereof include acrylic polyol resins, polyester polyol resins, and polyurethane polyol resins. Among these resins, acrylic polyol resins are preferably used because the resultant recording layer has good stability when colored, and good discoloring property.

The hydroxyl value of the resin included in the recording layer influences on the crosslinking density of the recording layer (i.e., the resistance of the recording layer to chemicals, and physical properties thereof). The present inventors discover that when the hydroxyl value of the resin in the recording layer is not less than 70 mgKOH/g, the durability, surface hardness and cracking resistance of the recording layer improve. Whether the resin in the recording layer has a hydroxyl value of not less than 70 mgKOH/g can be determined by analyzing the amount of the residual hydroxyl groups or the ether bonds.

When an acrylic polyol resin is used, the properties of the resultant recording layer change depending on the acrylic polyol resin used. Specifically, when an acrylic polyol is prepared, hydroxyethyl acrylate (HEA), hydroxypropyl acrylate (HPA), 2-hydroxyethyl methacrylate (HEMA), 2-hydroxypropyl methacrylate (HPMA), 2-hydroxybutyl monoacrylate (2-HBA), 1,4-hydroxybutyl monoacrylate (1-HBA), etc., are used as monomers having a hydroxyl group. Among these monomers, monomers having a primary hydroxyl group are preferably used and 2-hydroxyethyl methacrylate is more preferably used, because the resultant crosslinked resin has a good combination of cracking resistance and durability.

Suitable crosslinking agents for use in crosslinking a crosslinkable resin include known crosslinking agents such as isocyanate compounds, amines, phenolic compounds, epoxy compounds, etc. Among these compounds, isocyanate compounds are preferably used. Specific examples of the isocyanate compounds include urethane-modified isocyanate monomers, allophanate-modified isocyanate monomers, isocyanurate-modified isocyanate monomers, buret-modified isocyanate monomers, carbodiimide-modified isocyanate monomers, blocked isocyanate monomers, etc. Specific examples of the isocyanate monomers to be modified include tolylene diisocyanate (TDI), 4,4'-diphenylmethanediisocyanate (MDI), xylylene diisocyanate (XDI), naphtylene diisocyanate (NDI), paraphenylene diisocyanate (PPDI), tetramethylxylylene diisocyanate (TMXDI), hexamethylene diisocyante (HDI), dicyclohexylmethane diisocyanate (HMDI), isophorone diisocyante (IPDI), lysine diisocyante (LDI), isopropylidenebis(4-cyclohexylisocyante) (IPC), cyclohexyl diisocyante (CHDI), tolidinediisocyanate (TODI), etc., but are not limited thereto.

A catalyst for use in such a kind of crosslinking reaction can be used as a crosslinking promoter in the present invention. Specific examples of such a crosslinking promoter include tertiary amines such as 1,4-diaza-bicyclo[2,2,2] octane; metal compounds such as organic tin compounds.

All of the added crosslinking agent is not necessarily reacted with the binder resins, i.e., the recording layer may include a residue of the crosslinking agent, which remains without being reacted after the crosslinking reaction. Since this crosslinking reaction gradually proceeds, presence of a non-reacted crosslinking agent does not necessarily mean that the resin is not crosslinked at all. Whether or not the resin is crosslinked can be determined by dipping the recording layer in a solvent, which can dissolve the resin before a crosslinking reaction. Specifically, if the resin is not crosslinked, the entire recording layer is dissolved in such a solvent (i.e., there is no solid component in the liquid). Namely, whether or not the resin is crosslinked can be determined by checking the structure of solid components in the liquid.

In addition to a coloring agent, a color developer and a coloring/discoloring control agent having a Zwitter ion, the recording layer of the recording material of the present invention preferably includes a different kind of coloring/discoloring control agent, which includes a long chain hydrocarbon group and/or a hydrogen bond group such as amide groups and urea groups. In this case, the resultant colored images have good preservation stability and the colored images can be well discolored (i.e., the recording layer has good discoloring property). The added amount of such a different kind of coloring/discoloring control agent is not greater than 150 parts by weight, preferably not greater than 100 parts by weight, and more preferably not greater than 50 parts by weight, per 100 parts by weight of the coloring/discoloring control agent having a Zwitter ion.

The recording material of the present invention can include a protective layer including a crosslinked resin on the reversible thermosensitive recording layer. Suitable resins for use in the protective layer include thermosetting resins, ultraviolet crosslinking resins, and electron crosslinking resins. Among these resins, ultraviolet crosslinking resins, which have a group capable of absorbing ultraviolet rays, can be preferably used. Among these ultraviolet crosslinking resins, resins obtained from a monomer having a group capable of absorbing ultraviolet rays and a monomer having a crosslinkable group are preferable.

Suitable monomers for use as the monomers having an ultraviolet absorbing group include compounds having a benzotriazole moiety, such as 2-(2'-hydroxy-5'-methacryloxyethylphenyl)-2H-benzotriazole, 2-(2-hydroxy-5'-methylphenyl)benzotriazole, and 2-(2'-hydroxy-3'-ω-butyl-5'-methylphenyl)-5-Chlorobenzotriazole.

Specific examples of the monomers having a functional group include 2-isopropenyl-2-oxazoline, 2-aziridinylethyl (meth)acrylate, methacrylic acid, glycidyl(meth)acrylate, hydroxyethyl(meth)acrylate, hydroxypropyl(meth)acrylate, dimethylaminoethyl(meth)crylate, diethylaminoethyl(meth) crylate, t-butylaminoethyl(meth)acrylate, tetrahydrofurfuryl (meth)acrylate, etc. Among these monomers, hydroxyethyl (meth)acrylate and hydroxypropyl(meth)acrylate are more preferably used.

In order to prepare a polymer layer having high strength and heat resistance, the monomers having an ultraviolet absorbing group and the monomers having a functional group can be copolymerized with the following monomers.

Monomers such as styrene, styrene-butadiene, styrene -isobutylene, ethylene-vinyl acetate, vinyl acetate, methacrylonitrile, vinyl alcohol, vinyl pyrrolidone and (meth)acrylonitrile; (meth)acrylate monomers having no functional group, such as acrylic acid, methyl(meth) acrylate, ethyl(meth)acrylate, propyl(meth)acrylate, butyl(meth)acrylate, isobutyl (meth)acrylate, t-butyl(meth)acrylate, ethylhexyl(meth) acrylate, ocotyl(meth)acrylate, isodecyl(meth)acrylate, lauryl(meth)acrylate, lauryltridecyl(meth)acrylate, tridecyl (meth)acrylate, cetylstearyl(meth)acrylate, stearyl(meth) acrylate, cyclohexyl(meth)acrylate and benzyl(meth)acrylate; monomers having two or more polymerizable double bonds in their main chain, such as ethylene di(meth)acrylate, diethylene glycol di(meth)acrylate, triethylene glycol di(meth)acrylate, tetraethylene glycol di(meth)acrylate, decaethylene glycol di(meth)acrylate, pentacontahectaethylene glycol(meth)acrylate, butylene di(meth)acrylate, pentaerythritol tetra(meth)acrylate, trimethylolpropane tri(meth) acrylate, pentadecaethylene glycol di(meth)acrylate, di(meth)acrylate esters of diethyleneglycol phthalate; etc.

One or more of these monomers can be copolymerized with the monomers having an ultraviolet absorbing group and the monomers having a functional group.

Among these monomers, styrene, methyl(meth)acrylate, ethyl(meth)acrylate, propyl(meth)acrylate, butyl(meth)acrylate, isobutyl(meth)acrylate and t-butyl(meth)acrylate are preferably used.

Suitable polymers having an ultraviolet absorbing structure for use in the present invention include copolymers prepared by copolymerizing 2-(2'-hydroxy-5'-methacryloxyethylphenyl)-2H-benzotriazole, 2-hydroxyethyl methacrylate and styrene; copolymers prepared by copolymerizing 2-(2'-hydroxy-5'-methylphenyl)benzotriazole, 2-hydroxypropyl methacrylate and methyl methacrylate; etc. However, the polymer having an ultraviolet absorbing structure is not limited thereto.

The protective layer can include a particulate inorganic material capable of absorbing ultraviolet rays. The particulate inorganic material preferably has an average particle diameter of not greater than 0.1 μm. Specific examples of such inorganic materials include metal oxides such as zinc oxide, indium oxide, alumina, silica, zirconium oxide, tin oxide, cerium oxide, iron oxide, antimony oxide, barium oxide, calcium oxide, bismuth oxide, nickel oxide, magnesium oxide, chromium oxide, manganese oxide, tantalum oxide, niobium oxide, thorium oxide, hafnium oxide, molybdenum oxide, iron ferrite, nickel ferrite, cobalt ferrite, barium titanate and potassium titanate; carbonates such as calcium carbonate and magnesium carbonate; sulfides and sulfates such as zinc sulfide and barium sulfate; metal carbides such as titanium carbide, silicon carbide, molybdenum carbide, tungsten carbide and tantalum carbide; metal nitrides such as aluminum nitride, silicon nitride, boron nitride, zirconium nitride, vanadium nitride, titanium nitride, niobium nitride and gallium nitride; etc.

Among these inorganic materials having an average particle diameter not greater than 0.1 μm, inorganic materials capable of absorbing light having a wavelength not greater than 400 nm are more preferably used.

In addition, the protective layer of the recording material of the present invention can include one or more additives such as inorganic or organic fillers and lubricants, which are used for conventional reversible thermosensitive recording materials or the like.

The thickness of the protective layer is preferably from 0.5 to 10 μm, and more preferably from 1 to 5 μm.

The reversible thermosensitive recording material of the present invention can include an intermediate layer between the recording layer and the protective layer. The intermediate layer includes a resin such as the crosslinked resins and thermoplastic resins for use in the recording layer and the protective layer. Suitable resins for use as the crosslinked resins include thermosetting resins, ultraviolet crosslinking resins and electro beam crosslinking resins. Among these resins, thermosetting resins are preferably used. In addition, the intermediate layer can include an ultraviolet absorbing agent such as the organic and inorganic ultraviolet absorbing agents mentioned above for use in the recording layer and the protective layer. Further, the intermediate layer can include additives such as organic or inorganic fillers and lubricants.

The thickness of the intermediate layer is preferably from 0.5 to 10 μm, and more preferably from 1 to 5 μm.

The reversible thermosensitive recording material of the present invention can include an undercoat layer between the recording layer and the substrate. The undercoat layer is preferably an insulating undercoat layer including a hollow particulate material. The undercoat layer is preferably a layer in which a hollow organic or inorganic material having a hollow rate of not less than 30%, and preferably from 50 to 95%, is dispersed in a binder resin. The hollow rate is defined as the following equation.

$$\text{Hollow rate (\%)}=100\times ID/OD,$$

wherein ID represents the inside diameter of the hollow material, and OD represents the outside diameter thereof.

The particle diameter of the hollow organic or inorganic material included in the undercoat layer is typically from 0.1 to 10 μm, and preferably from 1 to 5 μm. The added amount of the hollow organic or inorganic material is generally not less than 30% by volume, and preferably from 50 to 80% by volume.

Specific examples of the hollow inorganic materials include particulate hollow glasses and particulate hollow ceramics. Specific examples of the hollow organic materials include particulate hollow resins such as acrylic resins and vinylidene chloride resins.

Specific examples of the binder resins for use in such an insulating undercoat layer include the resins for use in the recording layer, intermediate layer and protective layer, and known resins which can be used as binder resins. Among these resins, aqueous emulsions of the above-mentioned resins and water-soluble resins can be preferably used.

In addition, the undercoat layer can include additives such as fillers, surfactants and dispersants. Specific examples of the fillers include inorganic fillers such as calcium carbonate, magnesium carbonate, titanium oxide, silicon oxide, aluminum oxide, kaolin, and talc, and organic fillers such as particulate resins.

The thickness of the undercoat layer is from 2 to 30 μm, and preferably from 5 to 25 μm.

Suitable materials for use as the substrate of the recording material of the present invention include paper, resin films (e.g., polyethylene terephthalate films), synthetic paper, metal foils, glass and combinations thereof, etc. The substrate is not limited thereto, and any materials capable of supporting the recording layer can be used as the substrate. Laminates in which two or more of the above-mentioned materials are adhered to each other can be used as the substrate. The thickness of the substrate is determined depending on the purpose of the resultant recording material, and is from few micrometers to few millimeters, and preferably from 60 μm to 350 μm.

When the undercoat layer is formed between the substrate and the recording layer, the undercoat layer is preferably formed on the substrate with an adhesive layer therebetween to prevent formation of cracks and burrs. Suitable materials for use in the adhesive layer include thermosetting resins and thermoplastic resins mentioned above for use in preparing the recording layer and protective layer.

In addition, the recording material of the present invention can be used as a reversible thermosensitive recording label by forming an adhesive layer or a sticky layer (hereinafter referred to as an adhesive layer) on the backside of the substrate. Reversible thermosensitive recording labels are broadly classified into two types, non-release paper type labels including no release paper on the adhesive layer, and release paper type labels including a release paper on the adhesive layer. Hot-melt type adhesive materials are typically used for the adhesive layer of the non-release paper type labels, and any known adhesive materials can be used for the adhesive layer of the release paper type labels.

Specific examples of such adhesive materials include urea resins, melamine resins, phenolic resins, epoxy resins, vinyl acetate resins, vinyl acetate—acrylic copolymers, ethylene—vinyl acetate copolymers, acrylic resins, polyvinyl ether resins, vinyl chloride—vinyl acetate copolymers, polystyrene resins, polyester resins, polyurethane resins, polyamide resins, chlorinated polyolefin resins, polyvinyl butyral resins, acrylates copolymers, methacrylates copolymers, natural rubbers, cyano acrylate resins, silicone resins, etc.

The reversible thermosensitive recording material of the present invention can be used as an information display/storage material having both of a reversible display portion (i.e., the reversible thermosensitive recording portion) capable of reversibly displaying and erasing an image and an information storage portion capable of storing information. The information display/storage materials are broadly classified into the following three types:

(1) A reversible thermosensitive recording layer is directly formed on a part of an information storage device, wherein the information storage device serves as a substrate of the recording layer.
(2) A substrate is formed on a part of an information storage device, and the substrate of a reversible thermosensitive recording material is adhered to the first-mentioned substrate.
(3) A reversible thermosensitive recording label is adhered to an information storage device.

The position of the information storage portion on which the reversible thermosensitive recording layer or material is provided is not particularly limited as long as the functions of the reversible thermosensitive recording material and the information storage device can be performed. For example, an information storage device can be provided on the backside of the reversible thermosensitive recording material, or at a position between the substrate and the recording layer of the recording material. Further, an information storage device can be provided on a surface of the reversible thermosensitive recording material.

The information storage device for use in the present invention is not particularly limited. For example, cards, discs, disc cartridges and tape cassettes can be used. Specific examples thereof include thick cards such as IC cards and optical cards; disc cartridges including therein a rewritable disc such as flexible discs, magnetooptical discs (MDs), and DVD-RAMs; discs without a disc cartridge, such as CD-RWs; recordable discs such as CD-Rs; optical information recording media using a phase change information recording material, such as CD-RWs; video tape cassettes; etc.

Such an information display/storage material having both of a reversible display portion and an information storage portion has the following advantage. A piece of information stored in the information storage portion of, for example, a card, can be displayed in the reversible display portion. Therefore, the owner of the card can obtain the information without using a special information reading device. Namely, the card having such a display portion has much better convenience than a card without a display portion.

The information storage device for use in the information storage portion of the recording material of the present invention is not particularly limited as long as the device can store necessary information. For example, magnetic recording memories, contact-type ICs, noncontact-type ICs, and optical memories can be used therefor.

Magnetic recording memories can be formed by coating a coating liquid including a metal compound (e.g., iron oxides and barium ferrites) and a binder resin (e.g., vinyl chloride resins, urethane resins and nylon resins) or by forming a layer of such a metal compound using a method such as vapor deposition and spattering.

By forming a barcode (including two-dimensional barcodes) in the reversible thermosensitive recording portion, the recording portion can be used as the information storage portion.

One example of the information display/storage material using a reversible thermosensitive recording material is that a reversible thermosensitive recording label is adhered to a portion of the surface or the entire surface of a thick card such as polyvinyl chloride cards with a magnetic stripe, IC cards and optical cards. In this case, a piece of the information stored in the storage device can be displayed in the reversible thermosensitive recording label. Therefore, the information display/storage material has good convenience.

Figure 2:
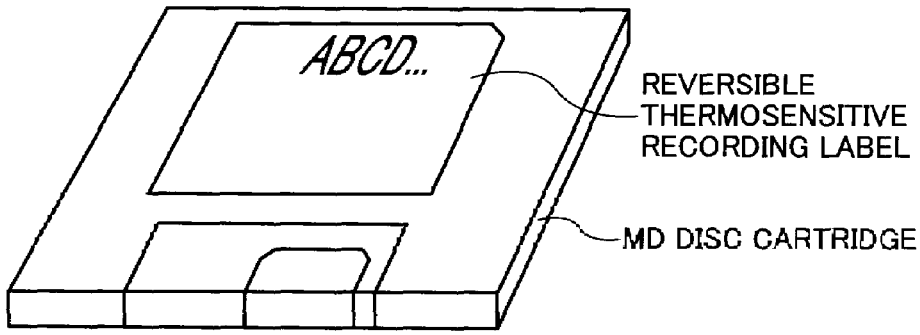
FIG. 2 is a schematic view illustrating a MD disc cartridge having thereon a label of the reversible thermosensitive recording medium of the present invention.

In addition, the reversible thermosensitive recording label can be adhered on a disc cartridge including a rewritable memories such as flexible discs, MDs and DVD-RAMs as illustrated in FIG. 2. In this case, the label can be used as a display label displaying the contents of the information stored in the memories.

Figure 3:
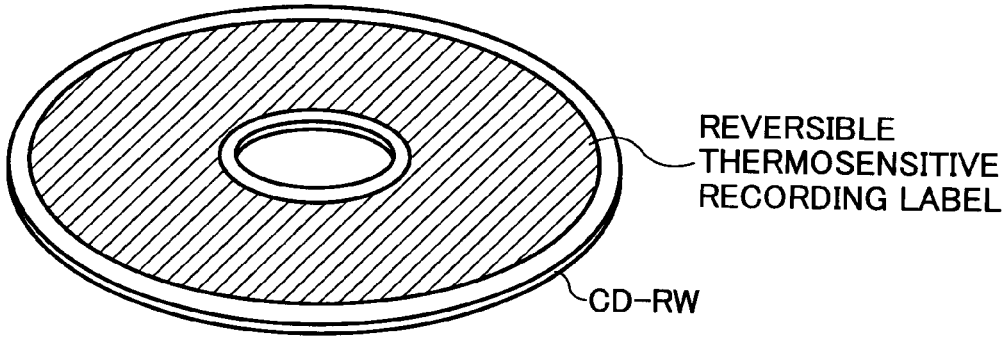
FIG. 3 is a schematic view illustrating a CD-RW having thereon a label of the reversible thermosensitive recording medium of the present invention.

In a case of a disc (e.g., CD-RWs) without a disc cartridge, a reversible thermosensitive recording label can be directly adhered on a surface of the disc or a reversible thermosensitive recording layer is formed on a surface of the disc as illustrated in FIG. 3. In this case, the label or the recording layer can be used as a display label displaying the contents of the information stored in the disc.

It is possible to adhere a reversible thermosensitive recording label to a recordable disc such as CD-Rs to display the additionally recorded information while rewriting the former information in the recording label.

Figure 4:
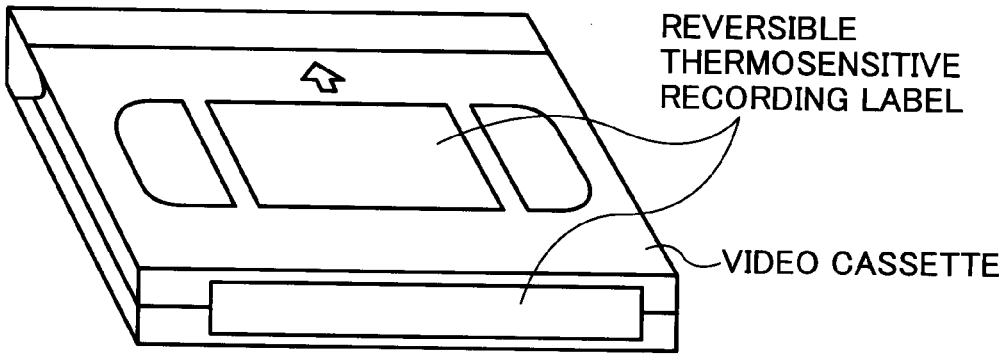
FIG. 4 is a schematic view illustrating a video cassette having thereon a label of the reversible thermosensitive recording medium of the present invention.

In addition, the reversible thermosensitive recording label can be used as a display label for a videotape cassette as illustrated in FIG. 4.

In order to add a reversible thermosensitive recording function to an information storage device such as thick cards, disc cartridges and discs, the following methods can be used.

(1) A reversible thermosensitive recording label is adhered to the information storage device.
(2) A reversible thermosensitive recording layer is directly formed on the information storage device by coating.

(3) A reversible thermosensitive recording layer, which is formed on a provisional substrate, is transferred to the information storage device.

When the method (3) is used, a hot-melt type adhesive layer can be formed on the surface of the recording layer so that the recording layer is adhered to the information storage device upon application of heat thereto.

In a case of an information display/storage material using a rigid substrate, such as thick cards, discs, disc cartridges and tape cassettes, a cushion layer or a cushion sheet is preferably provided between the rigid substrate and the recording label or recording layer such that a thermal printhead can be well contacted with the surface of the recording layer, resulting in formation of images with good image qualities (e.g., good image uniformity).

The present invention includes an image processing method for recording and/or erasing an image in the reversible thermosensitive recording material and the information display/storage material.

When image formation is performed, heating devices capable of imagewise heating the recording layer, such as thermal printheads and lasers can be used. When image erasure is performed, heating devices such as hot stamps, ceramic heaters, heat rollers, devices blowing hot air, thermal printheads and lasers can be used. Among these erasure heating devices, ceramic heaters, thermal printheads and lasers are preferably used. Ceramic heaters have advantages over heat rollers such that the erasing device can be miniaturized; erasing energy is relatively low; and erasure can be stably performed and thereby the resultant image has high contrast. When a ceramic heater is used, the temperature of the ceramic heater is preferably not lower than 100° C., more preferably not lower than 110° C., and even more preferably not lower than 115° C.

Figure 5:
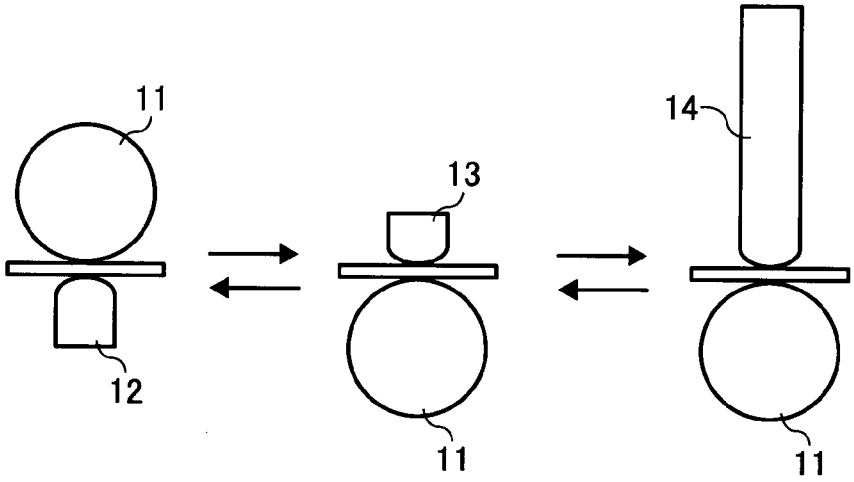
FIGS. 5 and 6 are schematic views illustrating recording devices for use in recording and/or erasing an image in the reversible thermosensitive recording medium of the present invention.

FIG. 5 illustrates an information reading/rewriting apparatus which reads and rewrites information stored in the memory of the reversible thermosensitive recording material of the present invention and rewriting an image in display portion of the reversible thermosensitive recording material of the present invention. In FIG. 5, numerals 11, 12, 13 and 14 denote feed rollers configured to feed the reversible thermosensitive recording material; a magnetic head configured to read and record information in a magnetic information storage portion of the recording material; a ceramic heater configured to erase a previously formed image; and a thermal printhead configured to record a new image in the recording material.

When a thermal printhead is used as an erasure heating device, the erasure heating device can be further miniaturized, and the electric power consumption can be reduced. Therefore, a battery-powered handy erasing device can be provided. Further, a recording/erasing device using only one thermal printhead can be provided. Such a recording/erasing device has a further small size. When image formation and erasure are performed using only one thermal printhead, a method in which the entire of the former image is erased and then a new image is recorded, or an overwriting method in which an image is formed while erasing the former image by changing heat energy applied to the recording layer can be used. The overwriting method has an advantage such that the total of the image forming time and the image erasing time can be reduced, resulting in increase of image recording speed.

Figure 6:
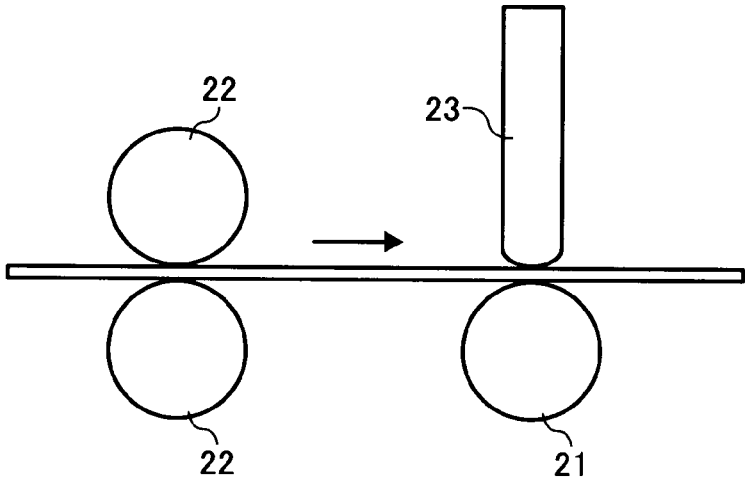

FIG. 6 illustrates another recording/erasing device using an overwriting method. Numerals 21, 22, and 23 denote a feed roller configured to feed the reversible thermosensitive recording material; feed rollers; and a thermal printhead configured to overwrite an image. Specifically, the thermal printhead 23 heats the entire of the display portion under a discoloring condition so that the display portion can achieve a non-colored state while heating an image portion of the display portion under an image forming condition.

Since image formation and erasure using a laser can be performed while the recording layer is not contacted with a laser beam irradiating device, damage of the surface of the recording layer due to abrasion of a contact heating device can be prevented. Therefore, a large number of rewriting operations can be performed on the recording layer.

When an information display/storage material is used, the image forming/erasing device includes a device of reading information in the memory as well as the rewriting device (i.e., the image forming/erasing device).

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

At first, the method for synthesizing coloring/discoloring control agents having formula (1) will be explained.

Synthesis Example 1

The method for synthesizing a compound having a Zwitter ion, which has the following formula, is as follows.

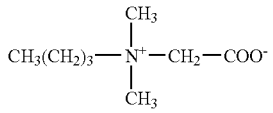

The following components were mixed in a three-necked flask.

| | |
|---|---|
| Sodium chloroacetate | 3.57 g |
| N-n-butyldimethyl amine | 3.10 g |
| Ion-exchange water | 100 ml |

The mixture was heated to 80° C. using a water bath and heating was continued for 5 hours at 80° C. to perform a reaction. Next, the reaction product was subjected to thin-layer chromatography using a developing solvent, in which chloroform and a methanol including 0.1 mol/l sulfuric acid in an amount of 10% are mixed in a ratio of 7/3, to confirm that the reaction proceeds. Water in the reaction product was removed using an evaporator. Thus, a transparent liquid was obtained. The liquid was dried to obtain a solid. The solid was dissolved in water, and the solution was washed three-times using ethyl acetate. Water in the aqueous phase of the wash fluid was then removed using an evaporator. Thus, a white liquid was obtained. The white liquid was subjected to vacuum drying at 80° C. Thus, 4.5 g of a white solid compound having the above-described formula was produced.

Synthesis Example 2

The method for synthesizing a compound having a Zwitter ion, which has the following formula, is as follows.

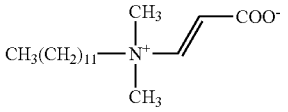

The following components were mixed in a three-necked

| | |
|---|---|
| N,N-dimethyl-n-dodecylamine | 5.10 g |
| Mixture solvent of dichloromethane and methanol in a ratio of 8:1 | 100 ml |

The mixture was agitated while cooled with water. Next, 2.34 g of ethyl propiolate was dropped into the mixture. The mixture was gradually heated to room temperature. Next, the reaction product was subjected to thin-layer chromatography to confirm that the reaction proceeds. After the reaction product (solution) was washed with dichloromethane, water in the reaction product was removed therefrom using an evaporator. Thus, a yellow solid was obtained. After being washed with dichloromethane, the yellow solid was subjected to a recrystallization treatment. Thus, 5.8 g of a pale yellow powder was prepared.

Synthesis Example 3

The method for synthesizing a compound having a Zwitter ion, which has the following formula, is as follows.

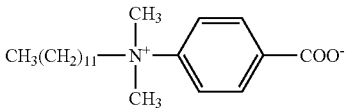

At first, 100 ml of ion-exchange water and 100 ml of chloroform were fed into a three-necked flask. Next, the following components were added thereto.

| | |
|---|---|
| Bromobenzoic acid | 7.16 g |
| Sodium hydrogen carbonate | 1.5 equivalent weight |

The mixture was heated to 50° C., and heating was continued for 2 hours at 50° C. while refluxing the mixture.

Further, 7.60 g of dimethyldodecylamine was added thereto, and the mixture was refluxed for 10 hours at 50° C. Next, the reaction product was subjected to thin-layer chromatography using a developing solvent in which chloroform and a methanol including 0.1 mol/l sulfuric acid in an amount of 10% are mixed in a ratio of 7/3, to confirm that the reaction proceeds. Water and chloroform in the reaction product were removed using an evaporator. Thus, a transparent solid was obtained. The solid was dissolved in ethyl acetate, and the solution was washed three-times using ion-exchange water. The solvent in the oil phase (i.e., the ethyl acetate solution) of the wash fluid was removed using an evaporator, resulting in formation of a white solid. The thus prepared white solid was dried at 120° C. As a result, 11.0 g of a white solid having the above-mentioned formula was prepared.

Synthesis Example 4

The method for synthesizing a compound having a Zwitter ion, which has the following formula, is as follows.

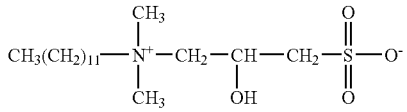

The following components were fed into a three-necked flask.

| | |
|---|---|
| Sodium salt of 1-bromo-2-hydroxypropanesulfonic acid | 8.48 g |
| N,N-dimethyl-n-dodecylamine | 9.20 g |
| Ion exchange water | 100 ml |

The mixture was heated to 80° C. using a water bath, and heating was continued for 5 hours at 80° C. to perform a reaction. Next, the reaction product was subjected to thin-layer chromatography using a developing solvent in which chloroform and a methanol including 0.1 mol/l sulfuric acid in an amount of 10% are mixed in a ratio of 7/3, to confirm that the reaction proceeds. Water in the reaction product was removed using an evaporator. Thus, a transparent pale yellow solid was obtained. The solid was dissolved in ion exchange water, and the solution was washed three-times using ethyl acetate. The solvent (water) in the aqueous phase of the wash fluid was removed using an evaporator, resulting in formation of a pale yellow solid. The thus prepared pale yellow solid was dried in vacuum. As a result, 15.0 g of a pale yellow solid having the above-mentioned formula was prepared.

Synthesis Example 5

The method for synthesizing a compound having a Zwitter ion, which has the following formula, is as follows.

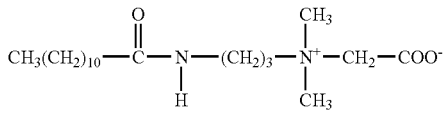

The following components were fed into a three-necked flask.

| | |
|---|---|
| Sodium chloroacetate | 1.64 g |
| 4-heptylamine | 4.0 g |
| Ion exchange water | 50 ml |

The mixture was heated to 80° C. using a water bath, and heating was continued for 5 hours at 80° C. to perform a reaction. Next, the reaction product was subjected to thin-layer chromatography using a developing solvent in which chloroform and a methanol including 0.1 mol/l sulfuric acid in an amount of 10% are mixed in a ratio of 7/3, to confirm that the reaction proceeds. Water in the reaction product was removed using an evaporator. Thus, a transparent pale yellow solid was obtained. The solid was dissolved in ion exchange water, and the solution was washed three-times using ethyl acetate. The solvent (water) in the aqueous phase of the wash fluid was removed using an evaporator, resulting in formation of a pale yellow solid. The thus prepared pale yellow solid was dried in vacuum. Thus, 4.8 g of a pale yellow solid having the above-mentioned formula was prepared.

Synthesis Example 6

The method for synthesizing a compound having a Zwitter ion, which has the following formula, is as follows.

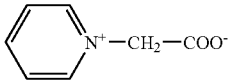

The following components were fed into a three-necked flask.

| | |
|---|---|
| Sodium chloroacetate | 3.24 g |
| Pyridine | 2.20 g |
| Ion exchange water | 100 ml |

The mixture was heated to 80° C. using a water bath, and heating was continued for 5 hours at 80° C. to perform a reaction. Next, the reaction product was subjected to thin-layer chromatography using a developing solvent in which chloroform and a methanol including 0.1 mol/l sulfuric acid in an amount of 10% are mixed in a ratio of 7/3, to confirm that the reaction proceeds. Water in the reaction product was removed using an evaporator. Thus, a transparent liquid was obtained. The liquid was dried to obtain a solid. The solid was dissolved in ion exchange water, and the solution was washed three-times using ethyl acetate. The solvent (water) in the aqueous phase of the wash fluid was removed using an evaporator, resulting in formation of a pale yellow solid. The thus prepared transparent liquid was dried at 80° C. in vacuum. Thus, 3.6 g of a white solid having the above-mentioned formula was prepared.

Synthesis Example 7

The method for synthesizing a compound having a Zwitter ion, which has the following formula, is as follows.

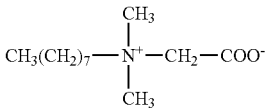

The following components were fed into a three-necked flask.

| | |
|---|---|
| Sodium chloroacetate | 4.0 g |
| N,N-dimethyloctylamine | 5.40 g |
| Ion exchange water | 100 ml |

The mixture was heated to 80° C. using a water bath, and heating was continued for 5 hours at 80° C. to perform a reaction. Next, the reaction product was subjected to thin-layer chromatography using a developing solvent in which chloroform and a methanol including 0.1 mol/l sulfuric acid in an amount of 10% are mixed in a ratio of 7/3, to confirm that the reaction proceeds. Water in the reaction product was removed using an evaporator. Thus, a transparent solid was obtained. The solid was dissolved in ion exchange water, and the solution was washed three-times using ethyl acetate. The solvent (water) in the aqueous phase of the wash fluid was removed using an evaporator, resulting in formation of a white solid. The thus prepared white solid was dried at 80° C. in vacuum. Thus, 7.0 g of a white solid having the above-mentioned formula was prepared.

Synthesis Example 8

The method for synthesizing a compound having a Zwitter ion, which has the following formula, is as follows.

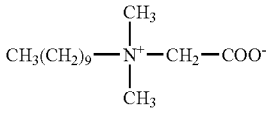

The following components were fed into a three-necked flask.

| | |
|---|---|
| Sodium chloroacetate | 2.00 g |
| N,N-dimethyldecylamine | 3.20 g |
| Ion exchange water | 80 ml |

The mixture was heated to 80° C. using a water bath, and heating was continued for 5 hours at 80° C. to perform a reaction. Next, the reaction product was subjected to thin-layer chromatography using a developing solvent in which chloroform and a methanol including 0.1 mol/l sulfuric acid in an amount of 10% are mixed in a ratio of 7/3, to confirm that the reaction proceeds. Water in the reaction product was removed using an evaporator. Thus, a transparent solid was obtained. The solid was dissolved in ion exchange water, and the solution was washed three-times using ethyl acetate. The solvent (water) in the aqueous phase of the wash fluid was removed using an evaporator, resulting in formation of a white solid. The thus prepared white solid was dried at 120° C. in vacuum. Thus, 4.1 g of a white solid having the above-mentioned formula was prepared.

Synthesis Example 9

The method for synthesizing a compound having a Zwitter ion, which has the following formula, is as follows.

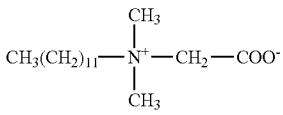

The following components were fed into a three-necked flask.

| | |
|---|---|
| Sodium chloroacetate | 2.60 g |
| N,N-dimethyl-n-dodecylamine | 4.70 g |
| Ion exchange water | 100 ml |

The mixture was heated to 80° C. using a water bath, and heating was continued for 5 hours at 80° C. to perform a reaction. Next, the reaction product was subjected to thin-layer chromatography using a developing solvent in which chloroform and a methanol including 0.1 mol/l sulfuric acid in an amount of 10% are mixed in a ratio of 7/3, to confirm that the reaction proceeds. Water in the reaction product was removed using an evaporator. Thus, a transparent solid was obtained. The solid was dissolved in ion exchange water, and the solution was washed three-times using ethyl acetate. The solvent (water) in the aqueous phase of the wash fluid was removed using an evaporator, resulting in formation of a white solid. The thus prepared white solid was dried at 120° C. in vacuum. Thus, 5.9 g of a white solid having the above-mentioned formula was prepared.

Synthesis Example 10

The method for synthesizing a compound having a Zwitter ion, which has the following formula, is as follows.

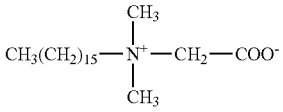

The following components were fed into a three-necked flask.

| | |
|---|---|
| Sodium chloroacetate | 9.30 g |
| N,N-dimethyl-n-hexadecylamine | 21.5 g |
| Ion exchange water | 300 ml |

The mixture was heated to 80° C. using a water bath, and heating was continued for 7 hours at 80° C. to perform a reaction. Next, the reaction product was subjected to thin-layer chromatography using a developing solvent in which chloroform and a methanol including 0.1 mol/l sulfuric acid in an amount of 10% are mixed in a ratio of 7/3, to confirm that the reaction proceeds. Water in the reaction product was removed using an evaporator. Thus, a transparent solid was obtained. The solid was dissolved in ion exchange water, and the solution was washed three-times using ethyl acetate. The solvent (water) in the aqueous phase of the wash fluid was removed using an evaporator, resulting in formation of a white solid. The thus prepared white solid was dried at 120° C., followed by drying at 80° C. under a reduced pressure. Thus, 25.0 g of a white solid having the above-mentioned formula was prepared.

Synthesis Example 11

The method for synthesizing a compound having a Zwitter ion, which has the following formula, is as follows.

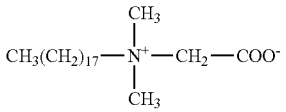

The following components were fed into a three-necked flask.

| | |
|---|---|
| Sodium chloroacetate | 0.59 g |
| N,N-dimethyl-n-octadecylamine | 1.50 g |
| Ion exchange water | 30 ml |

The mixture was heated to 80° C. using a water bath, and heating was continued for 5 hours at 80° C. to perform a reaction. Next, the reaction product was subjected to thin-layer chromatography using a developing solvent in which chloroform and a methanol including 0.1 mol/l sulfuric acid in an amount of 10% are mixed in a ratio of 7/3, to confirm that the reaction proceeds. Water in the reaction product was removed using an evaporator. Thus, a transparent solid was obtained. The solid was dissolved in ion exchange water, and the solution was washed three-times using ethyl acetate. The solvent (water) in the aqueous phase of the wash fluid was removed using an evaporator, resulting in formation of a white solid. The thus prepared white solid was dried at 120° C. in a chamber. Thus, 1.7 g of a white solid having the above-mentioned formula was prepared.

Synthesis Example 12

The method for synthesizing a compound having a Zwitter ion, which has the following formula, is as follows.

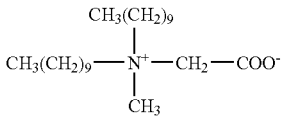

The following components were fed into a three-necked flask.

| | |
|---|---|
| Sodium chloroacetate | 5.91 g |
| Di-n-decylmethylamine | 15.8 g |
| Ion exchange water | 100 ml |

The mixture was heated to 80° C. using a water bath, and heating was continued for 5 hours at 80° C. to perform a reaction. Next, the reaction product was subjected to thin-layer chromatography using a developing solvent in which chloroform and a methanol including 0.1 mol/l sulfuric acid in an amount of 10% are mixed in a ratio of 7/3, to confirm that the reaction proceeds. Water in the reaction product was removed using an evaporator. Thus, a yellow liquid was obtained. The liquid was subjected to a separation/refinement treatment using silica-gel chromatography, followed by drying at 80° C. under a reduced pressure. Thus, 17.8 g of a pale yellow solid having the above-mentioned formula was prepared.

Synthesis Example 13

The method for synthesizing a compound having a Zwitter ion, which has the following formula, is as follows.

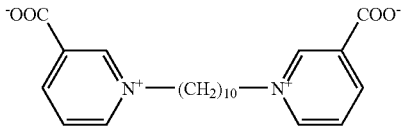

At first, 100 ml of tetrahydrofuran, 50 ml of ion-exchange water, 17.6 g of 1,10-dibromodecane, and 12.0 g of sodium nicotinate were fed into a three-necked flask. The mixture was refluxed for 7 hours at 70° C. The solvents in the mixture were gradually removed using an evaporator, resulting in formation of a pale yellow solid. The solid was subjected to decantation 5 times using butyl acetate, resulting in formation of a white solid. The white solid was dried at 60° C. in vacuum. Thus, 35.2 g of a white solid having the above-mentioned formula was prepared.

Synthesis Example 14

The method for synthesizing a compound having a Zwitter ion, which has the following formula, is as follows.

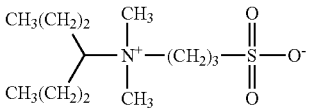

The following components were fed into a three-necked flask.

| | |
|---|---|
| Sodium 3-bromopropanesulfonate | 19.1 g |
| 4-heptyldimethylamine | 9.8 g |
| Ion exchange water | 100 ml |

The mixture was heated to 80° C. using a water bath, and heating was continued for 5 hours at 80° C. to perform a reaction. Next, the reaction product was subjected to thin-layer chromatography using a developing solvent in which chloroform and a methanol including 0.1 mol/l sulfuric acid in an amount of 10% are mixed in a ratio of 7/3, to confirm that the reaction proceeds. Water in the reaction product was removed using an evaporator. Thus, a pale yellow solid was obtained. The solid was dissolved in ion exchange water, and the solution was washed three-times using ethyl acetate. Water in the aqueous phase of the wash fluid was removed using an evaporator, and the residue was dried for 3 hours in vacuum. Thus, 22.5 g of a pale yellow solid having the above-mentioned formula was prepared.

Synthesis Example 15

The method for synthesizing a compound having a Zwitter ion, which has the following formula, is as follows.

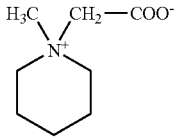

The following components were fed into a three-necked flask.

| | |
|---|---|
| Sodium chloroacetate | 8.6 g |
| 1-methylpiperidine | 7.3 g |
| Ion exchange water | 200 ml |

The mixture was heated to 80° C. using a water bath, and heating was continued for 5 hours at 80° C. to perform a reaction. Next, the reaction product was subjected to thin-layer chromatography using a developing solvent in which chloroform and a methanol including 0.1 mol/l sulfuric acid in an amount of 10% are mixed in a ratio of 7/3, to confirm that the reaction proceeds. Water in the reaction product was removed using an evaporator. Thus, a transparent solid was obtained. The solid was dissolved in ion exchange water, and the solution was washed three-times using ethyl acetate. Water of the aqueous phase was removed using an evaporator, and the residue was dried for 3 hours in vacuum. Thus, 11.3 g of a white solid having the above-mentioned formula was prepared.

Synthesis Example 16

The method for synthesizing a compound having a Zwitter ion, which has the following formula, is as follows.

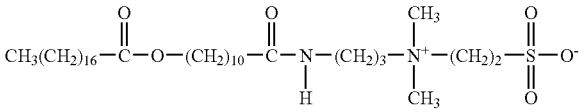

The following components were fed into a three-necked flask.

| | |
|---|---|
| Sodium 2-bromoethanesulfonate | 1.37 g |
| 10-(3-dimethylaminopropylcarbamoyl)decyl ester of octadecanoic acid | 3.7 g |
| Ion exchange water | 100 ml |

The mixture was heated to 80° C. using a water bath, and heating was continued for 5 hours at 80° C. to perform a reaction. Next, the reaction product was subjected to thin-layer chromatography using a developing solvent in which chloroform and a methanol including 0.1 mol/l sulfuric acid in an amount of 10% are mixed in a ratio of 7/3, to confirm that the reaction proceeds. Water in the reaction product was removed using an evaporator. Thus, a white solid was obtained. The solid was dissolved in tetrahydrofuran while heated, and the solution was cooled to re-crystallize the solid. The re-crystallized solid was dried for 3 hours in vacuum. Thus, 3.2 g of a white solid having the above-mentioned formula was prepared.

Synthesis Example 17

The method for synthesizing a compound having a Zwitter ion, which has the following formula, is as follows.

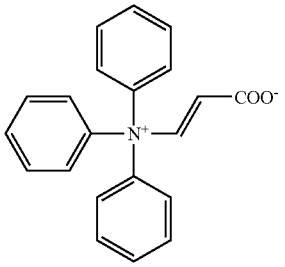

The following components were fed into a three-necked flask.

| | |
|---|---|
| Triphenylamine | 3.2 g |
| Mixture solvent of dichloromethane and methanol in a weight ratio of 8:1 | 100 ml |

The mixture was agitated while cooled by water. Next, 1.3 g of ethyl propiolate was gradually added thereto, and the mixture was warmed to room temperature. The reaction product was subjected to thin-layer chromatography using a developing solvent in which chloroform and a methanol including 0.1 mol/l sulfuric acid in an amount of 10% are mixed in a ratio of 7/3, to confirm that the reaction proceeds. Water in the reaction product was removed using an evaporator. Thus, a yellow solid was obtained. The liquid was subjected to a separation/refinement treatment using silica-gel chromatography using tetrahydrofuran, followed by drying for 3 hours at 60° C. in vacuum. Thus, 4.0 g of a pale yellow solid having the above-mentioned formula was prepared.

Synthesis Example 18

The method for synthesizing a compound having a Zwitter ion, which has the following formula, is as follows.

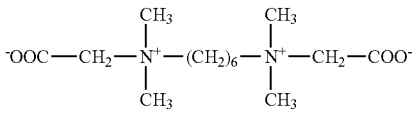

The following components were fed into a three-necked flask.

| | |
|---|---|
| Sodium chloroacetate | 6.1 g |
| N,N,N',N'-tetramethyldiaminohexane | 4.5 |
| Ion exchange water | 100 ml |

The mixture was heated to 80° C. using a water bath, and heating was continued for 10 hours at 80° C. to perform a reaction. Next, the reaction product was subjected to thin-layer chromatography using a developing solvent in which chloroform and a methanol including 0.1 mol/l sulfuric acid in an amount of 10% are mixed in a ratio of 7/3, to confirm that the reaction proceeds. Water in the reaction product was removed using an evaporator. Thus, a white crystal was obtained. The solid was dissolved in ion exchange water, and the solution was washed three-times using ethyl acetate. Water in the aqueous phase of the wash fluid was removed by an evaporator, and the residue was washed with hot ethyl acetate, followed by vacuum drying. Thus, 7.2 g of a white powder having the above-mentioned formula was prepared.

Synthesis Example 19

The method for synthesizing a compound having a Zwitter ion, which has the following formula, is as follows.

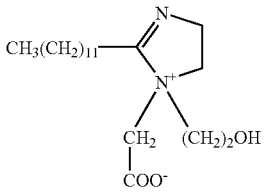

At first, 100 ml of tetrahydrofuran, 5.0 g of 2-hydrodecyl-1-(2-hydroxyethyl)imidazoline, 2.1 g of sodium chloroacetate and a small amount of sodium hydrogen carbonate were fed into a three-necked flask. The mixture was refluxed for 5 hours while heated. The solvent in the reaction product were gradually removed using an evaporator, resulting in formation of a white solid. The solid was dissolved in ion exchange water, and the solution was washed three-times using ethyl acetate. Water in the aqueous phase of the wash fluid was removed by an evaporator, and the residue was dried in vacuum, resulting in formation of a white powder. Thus, 5.5 g of a white powder having the above-mentioned formula was prepared.

Examples 1-43 and Comparative Examples 1-17

Preparation of Reversible Thermosensitive Recording Layer

The following components were mixed and pulverized using a ball mill to prepare a dispersion in which the solid components have an average particle diameter of about 1 μm.

| | |
|---|---|
| Color developer | 4 parts |
| Coloring/discoloring control agent | 0.4 parts |
| Acrylic polyol resin (LR503 from Mitsubishi Rayon Co., Ltd., solid content of 50%) | 9 parts |
| Methyl ethyl ketone | 70 parts |

The formulae of the color developers (B-1 to B-5) and the coloring/discoloring control agents (A-1 to A-27, and C-1 to C-8) used for Examples and Comparative Examples are listed in Tables 1-1, 1-2, 1-3, 2-1 and 2-2 below.

The resultant dispersion was mixed with the following components to prepare a reversible thermosensitive recording layer coating liquid.

| | |
|---|---|
| 2-anilino-3-methyl-6-dibutylaminofluoran | 1.5 parts |
| Adduct type hexamethylene diisocyanate (CORONATE HL from Nippon Polyurethane Industry Co., Ltd., an ethyl acetate solution having a solid content of 75%) | 2 parts |

The coating liquid was coated on a white polyethylene terephthalate film having a thickness of 100 μm using a wire bar, and the coated liquid was dried for 2 minutes at 100° C., followed by aging for 24 hours at 100° C. Thus, a reversible thermosensitive recording layer having a thickness of about 11.0 μm was prepared.

Preparation of Protective Layer

The following components were well mixed while agitated to prepare a protective layer coating liquid.

| | |
|---|---|
| Ultraviolet absorbing polymer (UV-G300 from Nippon Shokubai Co., Ltd., solid content of 40%) | 10 parts |
| Isocyanate type crosslinking agent (CORONATE HX from Nippon Polyurethane Industry Co., Ltd.) | 1.4 parts |
| Silicone-modified acrylic resin (GS-1015 from Toa Gosei Chemical Industry Co., Ltd.) | 0.5 parts |
| Methyl ethyl ketone | 10 parts |

The coating liquid was coated on the above-prepared recording layer using a wire bar, and the coated liquid was dried for 2 minutes at 100° C., followed by aging for 24 hours at 100° C. Thus, a protective layer having a thickness of about 3.5 μm was prepared.

The formulae of the coloring/discoloring control agents (A-1 to A-27, and C-1 to C-8) and the color developers (B-1 to B-5) used in Examples 1-43 and Comparative Examples 1-17 are listed in Tables 1 and 2 below.

TABLE 1-1

| Zwitter compound | Abbreviation | Manufacturer |
|---|---|---|
| 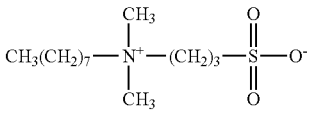 | A-1 | Sigma-Aldrich |
| 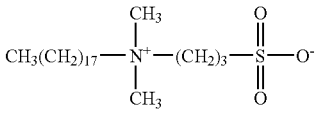 | A-2 | Tokyo Kasei Kogyo Co., Ltd. |
| 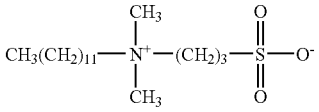 | A-3 | Tokyo Kasei Kogyo Co., Ltd. |
| 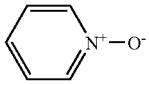 | A-4 | Tokyo Kasei Kogyo Co., Ltd. |
| 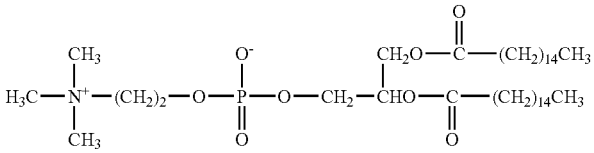 | A-5 | Sigma-Aldrich |
| 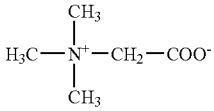 | A-6 | Tokyo Kasei Kogyo Co., Ltd. |
| 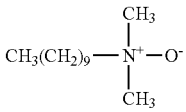 | A-7 | Sigma-Aldrich |
| 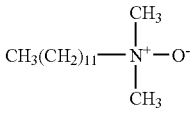 | A-8 | Sigma-Aldrich |

TABLE 1-1-continued

| Zwitter compound | Abbreviation | Manufacturer |
|---|---|---|
| $CH_3(CH_2)_3-N^+(CH_3)_2-CH_2-COO^-$ | A-9 | Produced in Synthesis Example 1 |

TABLE 1-2

| Zwitter compound | Abbreviation | Produced in |
|---|---|---|
| $CH_3(CH_2)_{11}-N^+(CH_3)_2-CH=CH-COO^-$ | A-10 | Synthesis Example 2 |
| $CH_3(CH_2)_{11}-N^+(CH_3)_2-C_6H_4-COO^-$ | A-11 | Synthesis Example 3 |
| $CH_3(CH_2)_{11}-N^+(CH_3)_2-CH_2-CH(OH)-CH_2-S(=O)_2-O^-$ | A-12 | Synthesis Example 4 |
| $CH_3(CH_2)_{10}-C(=O)-N(H)-(CH_2)_3-N^+(CH_3)_2-CH_2-COO^-$ | A-13 | Synthesis Example 5 |

TABLE 1-2-continued

| Zwitter compound | Abbreviation | Produced in |
|---|---|---|
| $C_5H_5N^+-CH_2-COO^-$ | A-14 | Synthesis Example 6 |
| $CH_3(CH_2)_7-N^+(CH_3)_2-CH_2-COO^-$ | A-15 | Synthesis Example 7 |
| $CH_3(CH_2)_9-N^+(CH_3)_2-CH_2-COO^-$ | A-16 | Synthesis Example 8 |
| $CH_3(CH_2)_{11}-N^+(CH_3)_2-CH_2-COO^-$ | A-17 | Synthesis Example 9 |
| $CH_3(CH_2)_{15}-N^+(CH_3)_2-CH_2-COO^-$ | A-18 | Synthesis Example 10 |

TABLE 1-3

| Zwitter compound | Abbreviation | Produced in |
|---|---|---|
| $CH_3(CH_2)_{17}-N^+(CH_3)_2-CH_2-COO^-$ | A-19 | Synthesis Example 11 |
| $CH_3(CH_2)_9-N^+(CH_3)(CH_3(CH_2)_9)-CH_2-COO^-$ | A-20 | Synthesis Example 12 |
| $^-OOC-C_5H_4N^+-(CH_2)_{10}-N^+C_5H_4-COO^-$ | A-21 | Synthesis Example 13 |

TABLE 1-3-continued
| Zwitter compound | Abbreviation | Produced in |
|---|---|---|
| 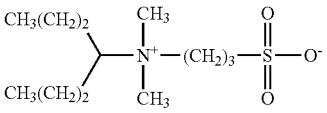 | A-22 | Synthesis Example 14 |
| 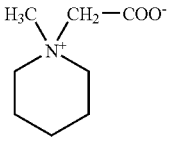 | A-23 | Synthesis Example 15 |
| 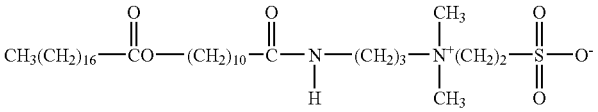 | A-24 | Synthesis Example 16 |
| 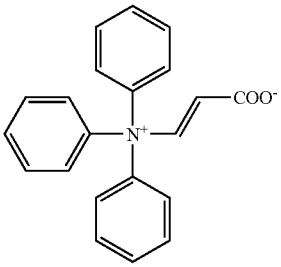 | A-25 | Synthesis Example 17 |
| 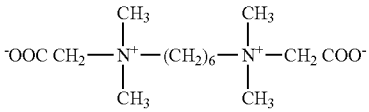 | A-26 | Synthesis Example 18 |
| 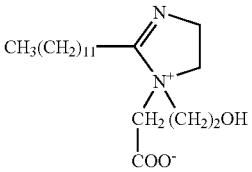 | A-27 | Synthesis Example 19 |
TABLE 2-1
| Color developer | Abbreviation |
|---|---|
| 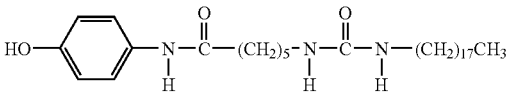 | B-1 |
| 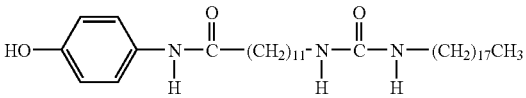 | B-2 |
| 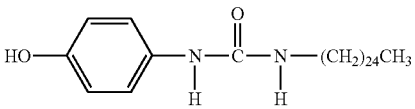 | B-3 |
TABLE 2-1-continued
| Color developer | Abbreviation |
|---|---|
| 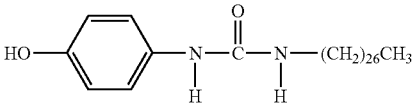 | B-4 |
| 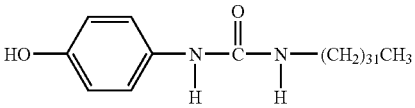 | B-5 |

TABLE 2-2

| Coloring/discoloring control agent (comparative examples) | Abbreviation |
|---|---|
| $CH_3(CH_2)_{17}-S(=O)_2-O^- \; Na^+$ | C-1 |
| $CH_3(CH_2)_{11}-N^+(CH_3)_2-CH_3 \; Cl^-$ | C-2 |
| $CH_3(CH_2)_8-N(H)-C(=O)-(CH_2)_3-N^+(CH_3)_2-CH_3 \; Cl^-$ | C-3 |
| $C_6H_5-N^+-(CH_2)_{11}CH_3 \; Cl^-$ | C-4 |
| $CH_3(CH_2)_{11}-N^+(CH_3)_2-CH_3 \; Br^-$ | C-5 |
| $CH_3(CH_2)_{17}-N^+(CH_3)_2-CH_3 \; Cl^-$ | C-6 |
| $H_2N-(CH_2)_{11}-COOH$ | C-7 |
| $CH_3(CH_2)_{17}-N(H)-C(=O)-N(H)-(CH_2)_{17}CH_3$ | C-8 |

In Examples 38-43 and Comparative Example 1, the added amount of the coloring/discoloring control agent was changed from 0.4 parts (i.e., 10% by weight based on the weight of the color developer) to the amounts described in Table 3 below.

TABLE 3

| | Coloring/discoloring control agent (CDCA) | Color developer (CD) | Added amount of CDCA (% by weight) |
|---|---|---|---|
| Example 23 | A-19 | B-3 | 10 |
| Example 38 | A-19 | B-3 | 0.1 |
| Example 39 | A-19 | B-3 | 1 |
| Example 40 | A-19 | B-3 | 5 |
| Example 41 | A-19 | B-3 | 20 |
| Example 42 | A-19 | B-3 | 30 |
| Example 43 | A-19 | B-3 | 50 |
| Comparative Example 1 | None | B-3 | 0 |

Example 23 is listed for comparison.

The thus prepared reversible thermosensitive recording materials were evaluated as follows.

1. Coloring Property

An image was recorded in each of the reversible thermosensitive recording materials under the following recording conditions.

Printer used: Thermal recording simulator (manufactured by BeCOM Co., Ltd.)

Recording device used: Thermal printhead

Voltage applied to thermal printhead: changed from 13V to 21V at intervals of 0.5V.

Pulse width: 2 msec

The optical densities of the images were measured with a densitometer, RD914 from Macbeth Co. Among the optical densities of the images recorded by changing the applied voltage, the highest optical density is defined as the maximum density and is described in Table 4 below.

In this regard, the higher the maximum density, the better the coloring property.

2. Discoloring Property

The image having the maximum density was heated under the following conditions to be erased.

Heating device used: HEAT GRADIENT TESTER from Toyo Seiki Seisaku-sho Ltd.

Pressure of heating element: $9.8\times10^4$ Pa (1 kgf/cm$^2$)

Heating time: 0.5 second

The temperature of the heating element of the heating device was properly set to a temperature of from 100 to 170° C. so that the image can be well discolored.

The optical density of a discolored portion and the background density of a background portion were measured using the densitometer RD-914 to determine the difference (i.e., the residual density (RD)) between the optical density and the background density (BD).

In this regard, the lower the residual density, the better the discoloring property.

3. High-speed Discoloring Property

Images having the maximum density ($D_{max}$) were recorded in each recording material. The images were erased by the thermal printhead by changing the voltage applied to the thermal printhead from 9 to 17V at intervals of 0.5V. The optical densities of the discolored portions were measured with the densitometer RD-914. Among these optical densities, the lowest density is defined as the minimum residual density ($RD_{min}$) The following thermal printhead erasure rate (TPER) was calculated to evaluate the high-speed discoloring property of each recording material.

$$\text{TPER}\ (\%)=(1-(RD_{min}-BD)/(D_{max}-BD))\times100$$

wherein $RD_{min}$ represents the minimum residual density, BD represents the background density of the recording material, and $D_{max}$ represents the maximum optical density.

In this regard, the higher the TPER, the better the high speed discoloring property.

4. High-temperature Preservability

The procedure for the recording and erasing operations for evaluating the discoloring property was repeated before and after a preservation test in which the colored image having the maximum density is preserved for 24 hours at 60° C. The high-temperature preservability (HTP) of each recording material was represented by the following equation.

$$\text{HTP}\ (\%)=(D_{max2}-BD_2)/(D_{max1}-BD_1)\times100$$

wherein $D_{max1}$ and $D_{max2}$ represent the maximum densities of the recording material before and after the preservation test, respectively, and $BD_1$ and $BD_2$ represent the background densities of the recording material before and after the preservation test, respectively.

With respect to the high-temperature preservability, the higher the better.

The evaluation results are shown in Tables 4-1 and 4-2 below.

TABLE 4-1

| | CDCA | CD | Coloring property | Discoloing property | TPER (%) | HTP (%) |
|---|---|---|---|---|---|---|
| Ex. 1 | A-1 | B-1 | 1.38 | 0.01 | 94 | 88 |
| Ex. 2 | A-1 | B-2 | 1.34 | 0.01 | 93 | 91 |
| Ex. 3 | A-1 | B-3 | 1.63 | 0.01 | 94 | 88 |
| Ex. 4 | A-1 | B-4 | 1.71 | 0.01 | 92 | 92 |
| Ex. 5 | A-1 | B-5 | 1.59 | 0.00 | 91 | 98 |
| Ex. 6 | A-2 | B-3 | 1.64 | 0.02 | 95 | 88 |
| Ex. 7 | A-3 | B-3 | 1.70 | 0.01 | 94 | 87 |
| Ex. 8 | A-4 | B-3 | 1.65 | 0.00 | 92 | 85 |
| Ex. 9 | A-5 | B-3 | 1.63 | 0.01 | 98 | 81 |
| Ex. 10 | A-6 | B-3 | 1.62 | 0.01 | 95 | 83 |
| Ex. 11 | A-7 | B-3 | 1.60 | 0.02 | 94 | 87 |
| Ex. 12 | A-8 | B-3 | 1.59 | 0.00 | 96 | 87 |
| Ex. 13 | A-9 | B-3 | 1.63 | 0.01 | 94 | 85 |
| Ex. 14 | A-10 | B-3 | 1.71 | 0.00 | 97 | 81 |
| Ex. 15 | A-11 | B-3 | 1.59 | 0.01 | 92 | 86 |
| Ex. 16 | A-12 | B-3 | 1.61 | 0.00 | 88 | 88 |
| Ex. 17 | A-13 | B-3 | 1.66 | 0.01 | 91 | 82 |
| Ex. 18 | A-14 | B-3 | 1.64 | 0.01 | 95 | 87 |
| Ex. 19 | A-15 | B-3 | 1.65 | 0.02 | 94 | 82 |
| Ex. 20 | A-16 | B-3 | 1.67 | 0.01 | 94 | 83 |
| Ex. 21 | A-17 | B-3 | 1.64 | 0.01 | 98 | 84 |
| Ex. 22 | A-18 | B-3 | 1.62 | 0.01 | 94 | 86 |
| Ex. 23 | A-19 | B-3 | 1.60 | 0.01 | 93 | 87 |
| Ex. 24 | A-20 | B-3 | 1.56 | 0.00 | 89 | 82 |
| Ex. 25 | A-21 | B-3 | 1.63 | 0.00 | 98 | 81 |
| Ex. 26 | A-22 | B-3 | 1.62 | 0.01 | 94 | 86 |
| Ex. 27 | A-23 | B-3 | 1.58 | 0.00 | 97 | 80 |
| Ex. 28 | A-24 | B-3 | 1.59 | 0.01 | 89 | 87 |
| Ex. 29 | A-25 | B-3 | 1.58 | 0.01 | 86 | 84 |
| Ex. 30 | A-26 | B-3 | 1.61 | 0.00 | 98 | 83 |

TABLE 4-2

| | CDCA | CD | Coloring property | Erasing property | TPER (%) | HTP (%) |
|---|---|---|---|---|---|---|
| Ex. 31 | A-27 | B-3 | 1.59 | 0.01 | 87 | 83 |
| Ex. 32 | A-2 | B-2 | 1.30 | 0.01 | 89 | 91 |
| Ex. 33 | A-7 | B-2 | 1.31 | 0.01 | 90 | 89 |
| Ex. 34 | A-19 | B-2 | 1.30 | 0.01 | 87 | 90 |
| Ex. 35 | A-2 | B-4 | 1.64 | 0.01 | 94 | 95 |
| Ex. 36 | A-7 | B-4 | 1.64 | 0.01 | 96 | 94 |
| Ex. 37 | A-19 | B-4 | 1.65 | 0.00 | 96 | 95 |
| Ex. 38 | A-19 | B-3 | 1.68 | 0.02 | 95 | 88 |
| Ex. 39 | A-19 | B-3 | 1.67 | 0.01 | 88 | 87 |
| Ex. 40 | A-19 | B-3 | 1.62 | 0.01 | 92 | 87 |
| Ex. 41 | A-19 | B-3 | 1.40 | 0.00 | 97 | 85 |
| Ex. 42 | A-19 | B-3 | 1.30 | 0.00 | 98 | 82 |
| Ex. 43 | A-19 | B-3 | 1.28 | 0.00 | 99 | 80 |
| Comp. Ex. 1 | None | B-3 | 1.69 | 0.14 | 72 | 88 |
| Comp. Ex. 2 | C-1 | B-3 | 1.71 | 0.34 | 48 | 72 |
| Comp. Ex. 3 | C-2 | B-1 | 0.98 | 0.04 | 79 | 60 |
| Comp. Ex. 4 | C-2 | B-2 | 0.98 | 0.03 | 79 | 42 |
| Comp. Ex. 5 | C-2 | B-3 | 1.16 | 0.04 | 79 | 28 |
| Comp. Ex. 6 | C-2 | B-4 | 1.19 | 0.03 | 81 | 58 |
| Comp. Ex. 7 | C-2 | B-5 | 1.18 | 0.04 | 82 | 60 |
| Comp. Ex. 8 | C-3 | B-3 | 1.19 | 0.05 | 76 | 42 |

TABLE 4-2-continued

| | CDCA | CD | Coloring property | Erasing property | TPER (%) | HTP (%) |
|---|---|---|---|---|---|---|
| Comp. Ex. 9 | C-4 | B-3 | 1.17 | 0.04 | 83 | 58 |
| Comp. Ex. 10 | C-5 | B-3 | 1.16 | 0.03 | 80 | 40 |
| Comp. Ex. 11 | C-6 | B-3 | 1.27 | 0.04 | 77 | 55 |
| Comp. Ex. 12 | C-7 | B-1 | 1.17 | 0.20 | 78 | 48 |
| Comp. Ex. 13 | C-7 | B-2 | 1.02 | 0.18 | 68 | 44 |
| Comp. Ex. 14 | C-7 | B-3 | 1.21 | 0.22 | 66 | 48 |
| Comp. Ex. 15 | C-7 | B-4 | 1.20 | 0.17 | 75 | 55 |
| Comp. Ex. 16 | C-7 | B-5 | 1.22 | 0.18 | 74 | 63 |
| Comp. Ex. 17 | C-8 | B-3 | 1.28 | 0.10 | 78 | 44 |

It is clear from Tables 4-1 and 4-2 that the reversible thermosensitive recording materials of the present invention have a good combination of coloring property, discoloring property, high-speed discoloring property and high-temperature preservability. Namely, the reversible thermosensitive recording materials of the present invention have good practicality.

This document claims priority and contains subject matter related to Japanese Patent Application No. 2006-128829, filed on May 8, 2006, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A reversible thermosensitive coloring material which can reversibly achieve a relatively colored state and a relatively discolored state depending on a temperature to which the reversible thermosensitive coloring material is heated or a cooling speed at which the reversible thermosensitive coloring material is cooled after heated, said coloring material comprising:

an electron donating coloring agent;

an electron accepting color developer configured to color the coloring agent; and a compound having a Zwitter ion in which a total of charges in a molecule of the compound is zero.

2. The reversible thermosensitive coloring material according to claim 1, wherein the compound having a Zwitter ion includes a nitrogen cation $N^+$, and an anion selected from the group consisting of $O^-$, $COO^-$, and $SO_3^-$.

3. The reversible thermosensitive coloring material according to claim 1, wherein the compound having a Zwitter ion has the following formula (1):

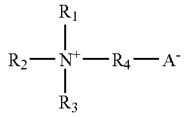

(1)

wherein each of $R_1$, $R_2$ and $R_3$ represents a saturated or unsaturated hydrocarbon group having 1 to 22 carbon atoms, or a group having the below-mentioned formula (A), wherein $R_1$, $R_2$ and $R_3$ optionally share bond connectivity to form a ring; $R_4$ represents a saturated or unsaturated hydrocarbon group having 1 to 18 carbon atoms, which optionally includes a hydroxyl group; and A represents an anion selected from the group consisting of $O^-$, $COO^-$ and $SO_3^-$, $$R_5—(—X—R_6—)_n— \quad (A)$$

wherein $R_5$ represents a saturated or unsaturated hydrocarbon group having 1 to 22 carbon atoms; $R_6$ represents a saturated or unsaturated divalent hydrocarbon group having 1 to 18 carbon atoms; X represents a group selected from the group consisting of carbamoyl groups, amide groups, urea groups, diacylhydrazine groups, ether groups, and ester groups; n is an integer of from 1 to 3, wherein when n is 2 or more, each of $R_6$ is the same as or different from each other and each of X is the same as or different from each other.

4. The reversible thermosensitive coloring material according to claim 1, wherein the electron accepting color developer includes a phenolic compound having an aliphatic group including not less than 8 carbon atoms, and having the following formula:

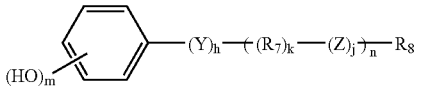

wherein each of Y and Z represents a divalent group including a hetero atom, and each of h and j is 0 or 1, wherein both of h and j are not 0 at the same time; $R_7$ represents a divalent hydrocarbon group having 1 to 22 carbon atoms; k is 0 or 1; $R_8$ represents a hydrocarbon group having 8 to 30 carbon atoms; m is an integer of from 1 to 3; and n is 0 or an integer of from 1 to 4, wherein when n is an integer of from 2 to 4, each of $R_7$ is the same as or different from each other and each of Z is the same as or different from each other, and wherein when n is 0, h is 1.

5. The reversible thermosensitive coloring material according to claim 4, wherein each of Y and Z represents a divalent group selected from the group consisting of —NH—, —CO—, —O—, —$SO_2$—, and —S—.

6. A reversible thermosensitive recording material comprising:

a substrate; and a reversible thermosensitive recording layer which is located overlying the substrate and which can reversibly achieve a relatively colored state and a relatively discolored state depending on a temperature to which the reversible thermosensitive recording layer is heated or a cooling speed at which the reversible thermosensitive recording layer is cooled after heated, wherein the reversible thermosensitive recording layer includes the reversible thermosensitive coloring material according to claim 1.

7. The reversible thermosensitive recording material according to claim 6, further comprising:

an information storage device configured to store information, wherein the reversible thermosensitive recording layer displays at least a piece of the information stored in the information storage device.

8. The reversible thermosensitive recording material according to claim 7, wherein the information storage device includes a memory selected from the group consisting of ICs, magnetic memories and optical memories.

9. The reversible thermosensitive recording material according to claim 6, wherein the compound having a Zwitter ion includes a nitrogen cation $N^+$, and an anion selected from the group consisting of $O^-$, $COO^-$, and $SO_3^-$.

10. The reversible thermosensitive recording material according to claim 6, wherein the compound having a Zwitter ion has the following formula (1):

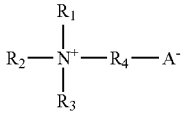

(1)

wherein each of $R_1$, $R_2$ and $R_3$ represents a saturated or unsaturated hydrocarbon group having 1 to 22 carbon atoms, or a group having the below-mentioned formula (A), wherein $R_1$, $R_2$ and $R_3$ optionally share bond connectivity to form a ring; $R_4$ represents a saturated or unsaturated hydrocarbon group having 1 to 18 carbon atoms, which optionally includes a hydroxyl group; and A represents an anion selected from the group consisting of $O^-$, $COO^-$ and $SO_3^-$, $$R_5—(—X—R_6—)_n— \quad (A)$$

wherein $R_5$ represents a saturated or unsaturated hydrocarbon group having 1 to 22 carbon atoms; $R_6$ represents a saturated or unsaturated divalent hydrocarbon group having 1 to 18 carbon atoms; X represents a group selected from the group consisting of carbamoyl groups, amide groups, urea groups, diacylhydrazine groups, ether groups, and ester groups; n is an integer of from 1 to 3, wherein when n is 2 or more, each of $R_6$ is the same as or different from each other and each of X is the same as or different from each other.

11. The reversible thermosensitive recording material according to claim 6, wherein the electron accepting color developer includes a phenolic compound having an aliphatic group including not less than 8 carbon atoms, and having the following formula:

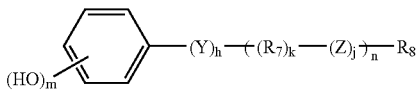

wherein each of Y and Z represents a divalent group including a hetero atom, and each of h and j is 0 or 1, wherein both of h and j are not 0 at the same time; $R_7$ represents a divalent hydrocarbon group having 1 to 22 carbon atoms; k is 0 or 1; $R_8$ represents a hydrocarbon group having 8 to 30 carbon atoms; m is an integer of from 1 to 3; and n is 0 or an integer of from 1 to 4, wherein when n is an integer of from 2 to 4, each of $R_7$ is the same as or different from each other and each of Z is the same as or different from each other, and wherein when n is 0, h is 1.

12. The reversible thermosensitive recording material according to claim 11, wherein each of Y and Z represents a divalent group selected from the group consisting of —NH—, —CO—, —O—, —$SO_2$—, and —S—.

* * * * *